US007000916B2

(12) United States Patent
Asada et al.

(10) Patent No.: US 7,000,916 B2
(45) Date of Patent: Feb. 21, 2006

(54) SHEET-SUPPLY DEVICE

(75) Inventors: Tetsuo Asada, Kuwana (JP); Takatoshi Takemoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 219 days.

(21) Appl. No.: 10/619,674

(22) Filed: Jul. 16, 2003

(65) Prior Publication Data

US 2004/0017039 A1 Jan. 29, 2004

(30) Foreign Application Priority Data

Jul. 23, 2002 (JP) ..... 2002-213515

(51) Int. Cl.
*B65H 1/08* (2006.01)
*B65H 3/54* (2006.01)

(52) U.S. Cl. ..... 271/121; 271/167

(58) Field of Classification Search ..... 271/121, 271/167, 126

See application file for complete search history.

(56) References Cited

U.S. PATENT DOCUMENTS

| | | | | |
|---|---|---|---|---|
| 5,857,671 | A * | 1/1999 | Kato et al. | 271/10.11 |
| 2002/0011702 | A1 | 1/2002 | Otsuka et al. | |
| 2004/0251602 | A1 * | 12/2004 | Ruhe et al. | 271/167 |

FOREIGN PATENT DOCUMENTS

| | | | |
|---|---|---|---|
| EP | 1 160 185 A2 | | 12/2001 |
| JP | 5-201556 | * | 8/1993 |
| JP | 11-71036 | | 3/1999 |
| JP | A 11-71036 | | 3/1999 |
| JP | 2000-191169 | | 7/2000 |
| JP | A 2000-191169 | | 7/2000 |
| JP | 2001-253580 | | 9/2001 |
| JP | A 2001-253580 | | 9/2001 |
| JP | A 2001-341876 | | 12/2001 |
| JP | 2001-341876 | | 12/2001 |
| JP | A 2001-354330 | | 12/2001 |
| JP | 2001-354330 | | 12/2001 |

OTHER PUBLICATIONS

Asada et al., "Sheet–Supply Device and Printing Device Including the Same", Jul. 16, 2003.

Asada et al., "Sheet–Supply Device and Printing Device Including the Same", Attorney Docket No. 116245, Jul. 16, 2003.

* cited by examiner

*Primary Examiner*—Donald P. Walsh
*Assistant Examiner*—Kenneth W. Bower
(74) *Attorney, Agent, or Firm*—Oliff & Berridge, PLC

(57) ABSTRACT

A sheet-supply device includes a pair of stopper members provided to a bottom plate of a hopper portion so as to move between a protruding position where upper surfaces of the stopper members protrude from a surface of the bottom plate and a retracted position where upper surfaces of the stopper members retract from the surface of the bottom plate, and a position change mechanism moving the stopper members between the protruding and retracted positions. By changing a timing of ascending the stopper members to the protruding position according to a type of the sheets to be fed, an appropriate resistance is applied to all of the sheets in the hopper portion except a topmost sheet during a sheet feed operation, thereby preventing a multi-feed problem. The stopper members moves up and down several times via the position change mechanism at a time between after the sheet feed operation is completed and before a next sheet feed operation starts, thereby positioning the sheets, which may cause the multi-feed problem, at a predetermined sheet holding position.

18 Claims, 21 Drawing Sheets

SHEET-SUPPLY DEVICE

BACKGROUND OF THE INVENTION

1. Field of Invention

The invention relates to a sheet-supply device that separates and feeds sheets, one by one, from a stack of sheets held in an inclined position by a hopper portion, and more particularly, to a sheet-supply device that prevents two or more sheets from being fed at one time during a sheet feed operation.

2. Description of Related Art

Commonly, various recording apparatuses, such as printers and facsimile machines, include a sheet-supply device that separates and feeds sheets, one by one, from a stack of sheets held by a hopper portion. Currently, two types of sheet-supply device are practical in use. One type of the sheet-supply device holds a plurality of sheets in a horizontal position, and another type of the sheet-supply device holds a plurality of sheets in an inclined position. Recently, the latter type of the sheet-supply device has been most commonly adopted to save installation space. However, because lower edges of the sheets in the inclined position are received by a lower edge receiving portion provided in a substantially horizontal position, the lower edges of the sheets are likely to slide over the lower edge receiving portion. In addition, there is a high possibility that two or more sheets are to be fed at one time (a multi-feed problem likely occurs) in the inclined-type sheet-supply device.

There have been proposed various multi-feed prevention techniques in the inclined-type sheet-supply devices. For example, U.S. Patent Application Publication No. US 2002/0011702 A1 discloses a paper feeder that includes a paper feeding roller, which is provided downstream of a hopper in a paper feed direction, and a rotatable paper returner, which is provided downstream in the paper feed direction, and has a separation pad. The paper returner stands up almost vertically for blocking accidental entry of paper into a paper transporting passage when paper is set. When the paper feeding roller rotates as paper feed starts, the paper returner is gradually inclined toward a fall-down position.

When the paper returner reaches the fall-down position and the hopper is moved up to a topmost position, a top sheet is pressed by the paper feeding roller and thus conveyed along the paper guide by the paper feeding roller. Then, the hopper moves down before a leading end of the fed paper arrives at transport rollers, and then the paper returner is rotated to a stand-up position. That is, the position of the paper returner is changed to the stand-up position while conveying the paper, resulting in preventing a multi-feed problem.

As described above, in the paper feeder disclosed in U.S. Patent Application Publication No. US 2002/0011702 A1, the paper returner is gradually rotated from the stand-up position to the fall-down position when paper feed starts, and the paper returner is gradually rotated from the fall-down position to the stand-up position as the leading end of the paper arrives at the transport rollers. However, while paper is being fed, that is, the paper returner is maintained at the fall-down position, the feeding of other sheets of paper and the top sheet in the paper feed direction is not regulated. Thus, there is a high possibility that two or more sheets of paper are fed at one time when paper feed is performed by the paper feeding roller.

Although it is conceivable that the multi-feed problem is prevented by changing the position of the paper returner to the stand-up position immediately after paper feed is started by the paper feeding roller, the paper returner cannot be rotated to the stand-up position because the paper returner is located under the paper feeding roller when the paper feed starts. In addition, when a plurality of sheets of paper are held by the hopper, no preventive measures are taken in order to prevent feeding two or more sheets of paper at one time even though there is a high possibility the multi-feed problem may occur.

SUMMARY OF THE INVENTION

The invention provides a sheet-supply device that prevents feeding two or more sheets at one time (a multi-feed problem) from a stack of sheets held by a hopper portion, during a sheet feed operation.

According to one aspect of the invention, a sheet-supply device includes a hopper portion that has an inclined wall for holding a stack of sheets in an inclined position and a lower edge receiving portion capable of receiving lower edges of the sheets, a sheet feed mechanism that includes a sheet-supply roller which separates and feeds a topmost sheet from the stack of sheets held by the hopper portion, a stopper member that is provided to a bottom plate of the hopper portion so that a position of the stopper member can be changed between a protruding position where the stopper member protrudes from an upper surface of the bottom plate and a retracted position where the stopper member retracts below the upper surface of the bottom plate, and applies a resistance to movement of the sheets in the sheet feed direction, a position change mechanism that changes the position of the stopper member between the protruding position and the retracted position and changes the position of the stopper member from the protruding position to the retracted position at least when the sheet feed operation is performed by the sheet-supply roller, and a position change control device that controls the up-and-down movement of the stopper member in accordance with a condition of the sheets held by the hopper portion. A "condition" of the sheets refers to an amount of the sheets, a type of the sheets (i.e. matter sheet, coated paper, plain paper, paper specialized for inkjet, etc.), and a size of the sheets.

With this structure, the stopper member is moved up and down in accordance with a condition of the sheets in a series of operations of the sheet feed operation. Accordingly, an appropriate regulating force according to the type of sheets is applied by the stopper member to the lower edges of the rest of the sheets held by the hopper portion. Consequently, the sheets do not undesirably move in the sheet feed direction, thereby preventing the multi-feed problem in the sheet feed operation.

A time at which the up-and-down movement of the stopper member is performed between the instant when the sheet feed operation starts and the instant when a leading edge of the fed sheet reaches resist rollers disposed in the downstream in the sheet feed direction, may be determined in accordance with a type of the sheets held by the hopper portion. By doing so, an appropriate slide resistance according to the type of the sheets can be applied to the lower edges of the rest of the sheets during the sheet feed operation, so that the rest of the sheets are prevented from being undesirably fed in the sheet feed direction.

The stopper member may be moved up and down several times in accordance with the condition of the sheets held by the hopper portion at a time after the sheet feed operation is completed and before a next sheet feed operation starts, while the sheets held by the hopper portion is urged. By doing so, the sheets are positioned at the predetermined sheet holding position by the up-and-down movement of the stopper member and the positioned sheets are held by an urging member to prevent the multi-feed problem, even when the situation that is likely to cause the multi-feed problem occurs due to shifting of the sheets in the sheet feed direction. That is, sheets, which may cause the multi-feed problem, are positioned at the predetermined sheet holding position after the sheet feed operation is completed, thereby preventing the multi-feed problem from occurring at a next sheet feed operation.

The sheet feed operation mechanism may be provided to drive the position change mechanism and the sheet-supply roller in synchronization with each other. When the position of the stopper member is changed to the retracted position via the position change mechanism as the sheet feed operation starts, the sheet feed operation mechanism drives the position change mechanism and the sheet feed roller at the same time as required. By doing so, the sheet-supply roller is rotated by the position change mechanism as the sheet feed operation starts, thereby feeding a sheet from the stack of sheets.

The stopper member may include a pair of stopper members, which are provided away from each other in a sheet width direction. Between the stopper members, a friction pad may be provided to the lower edge receiving portion in order to apply a slide resistance to the movement of the lower edges of the sheets in the sheet feed direction. With this structure, the pair of stopper members further prevent the sheets from undesirably moving in the sheet feed direction during standby. While both of the stopper members are maintained at the retracted position, a slide resistance is applied to the sheets except the topmost sheet by the separating pad, which is a part of the lower edge receiving portion. Accordingly, the rest of the sheets are inhibited from moving in the sheet feed direction together with the topmost sheet during the sheet feed operation, thereby preventing the occurrence of the multi-feed problem.

Each of the stopper members may have a sawtoothed regulating surface at an upper surface thereof. The sawtoothed regulating surfaces of the stopper members significantly increase the resistance to the movement in the sheet feed direction of the sheets held by the hopper portion, whereby the movement of the sheets in the sheet feed direction can be prevented.

In order to achieve the above object, a sheet supply method using the sheet-supply device of the invention includes the step of changing the position of the stopper member to the retracted position from the protruding position by the position change mechanism, the step of supplying a topmost sheet from the stack of sheets held by the hopper portion by driving the sheet-supply roller of the sheet feed mechanism, and the step of changing the position of the stopper member to the protruding position from the retracted position when a leading edge of the fed sheet passes the stopper member.

According to this operation, the stopper member is ascended to the protruding position immediately after a topmost sheet is separated from a second topmost sheet, while the topmost sheet is being fed by the sheet-supply roller. Therefore, the undesirable movement of the rest of the sheets in the sheet feed direction is surely inhibited, thereby preventing the multi-feed problem in a sheet feed operation.

In order to achieve the above object, a sheet supply method using the sheet-supply device of the invention includes the step of changing the position of the stopper member to the retracted position from the protruding position by the position change mechanism, the step of supplying a topmost sheet from the stack of sheets held by the hopper portion by driving the sheet-supply roller of the sheet feed mechanism, and the step of moving the stopper member up and down several times via the position change mechanism at a time between after the sheet feed operation is completed and before a next sheet feed operation is performed.

During standby in which the sheet feed operation is not performed, the stopper member is located at the protruding position where the upper surface of the stopper member protrudes from the upper surface of the bottom plate of the hopper portion. A resistance caused by the stopper member located at the protruding position, is applied to the movement in the sheet feed direction of the lower edges of the sheets held in the inclined position by the hopper portion. Therefore, the sheets do not move undesirably in the sheet feed direction. Because the stopper member is changed to the retracted position by the position change mechanism when the sheet feed operation is performed, only a topmost sheet is separated and fed from the stack of sheets by the rotation of the sheet-supply roller.

Because the stopper member stays at the retracted position only for a short time while a topmost sheet is fed, the multi-feed problem caused by the rest of the sheets can be prevented. While the stopper member is maintained at the retracted position, the lower edge receiving portion of the hopper portion inhibits the movement in the sheet feed direction of the rest of the sheets as much as possible, thereby preventing the multi-feed problem in the sheet feed operation.

The stopper member may be moved up and down several times after the sheet feed operation is completed, even when the situation that is likely to cause the multi-feed problem occurs due to shifting of the sheets in the sheet feed direction. By doing so, the sheets are positioned at the predetermined sheet holding position by the up-and-down movement of the stopper member and the positioned sheets are held by the urging member. That is, sheets, which may cause the multi-feed problem, are positioned at the predetermined sheet holding position after the sheet feed operation is completed, thereby preventing the multi-feed problem from occurring at a next sheet feed operation.

BRIEF DESCRIPTION OF THE DRAWINGS

An embodiment of the invention will be described in detail with reference to the following figures wherein.

DETAILED DESCRIPTION OF PREFERRED EMBODIMENTS

An embodiment of the invention will be described with reference to the accompanying drawings.

In this embodiment, the invention is applied to a sheet-supply device of a multifunctional apparatus that has a printing function, a copying function, a scanning function, a facsimile function, and a telephone function.

Figure 1:
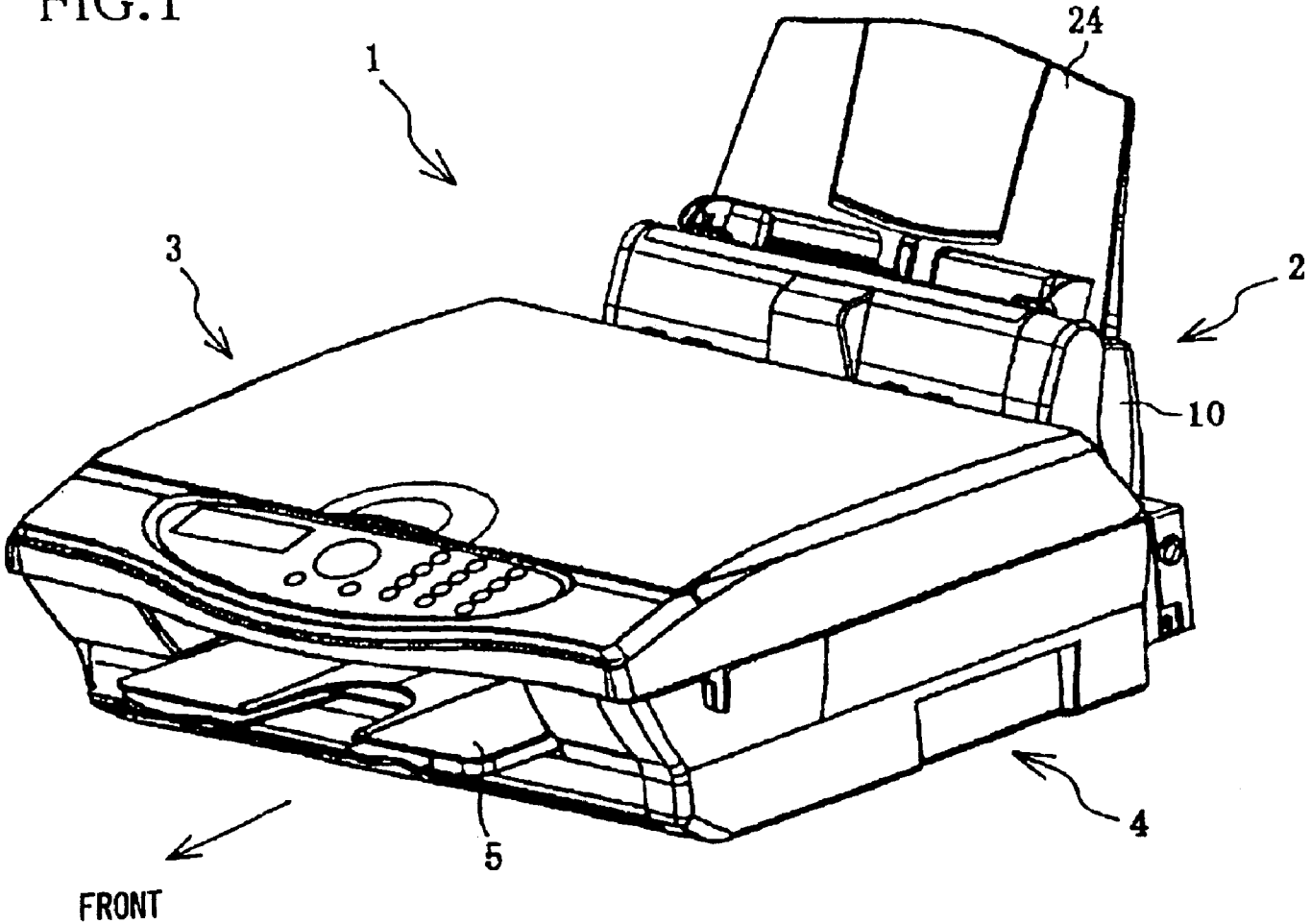
FIG. 1 is a perspective view of a multifunctional apparatus according to one embodiment of the invention.

As shown in FIG. 1, a multifunctional apparatus 1 includes a sheet-supply device 2, a document reading device 3, and an ink-jet printing device 4. The right and left sides of the multifunctional apparatus 1 are defined as right and left, respectively, when viewed from the front of the multifunctional apparatus 1. The sheet-supply device 2 is provided in the rear of the multifunctional apparatus 1. The document reading device 3, which performs the copying and facsimile functions, is provided in front of the sheet-supply device 2 and on the ink-jet printing device 4. The ink-jet printing device 4, provided below the document reading device 3, has a sheet output table 5 for receiving printed sheets in the front, as indicated in FIG. 1.

The sheet-supply device 2 will be described with reference to FIGS. 2, 3, 5, 8, and 10.

Figure 7:
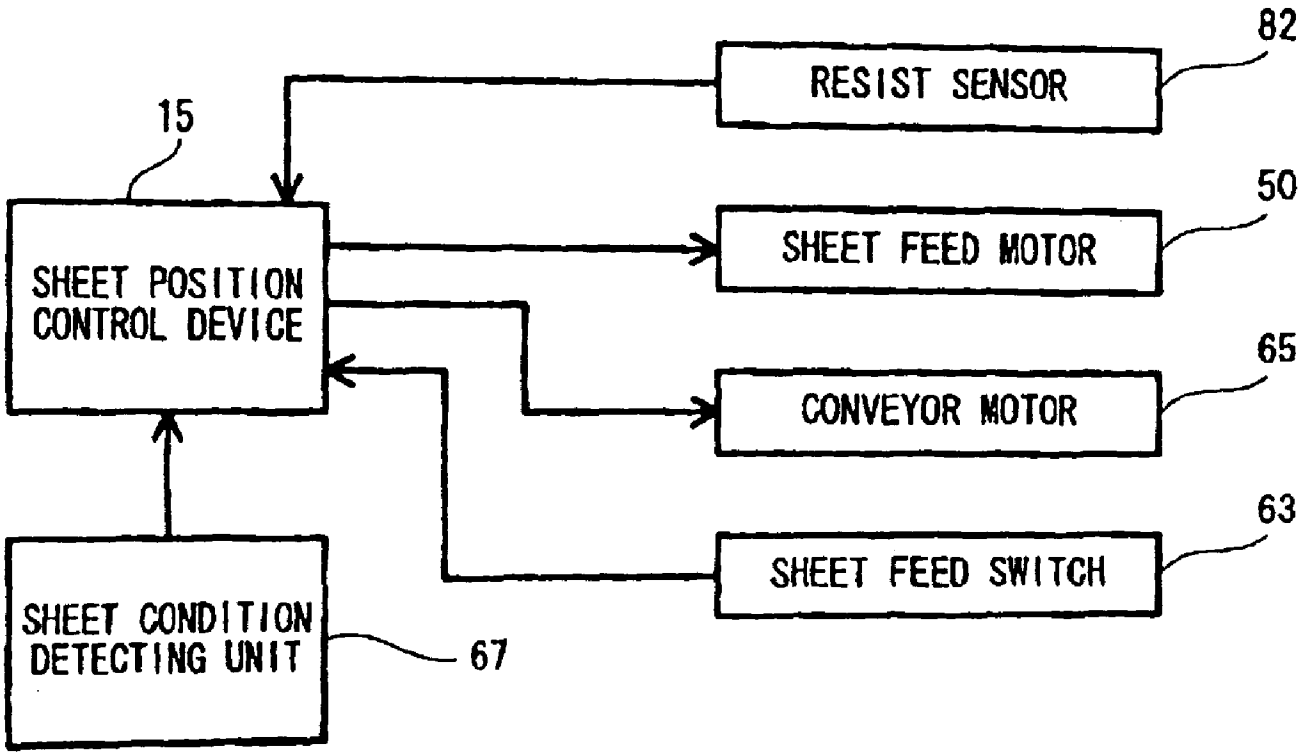
FIG. 7 is a block diagram of a control system including a sheet position control device.

The sheet-supply device 2 includes a hopper portion 10 that holds a plurality of sheets in an inclined position, a sheet feed mechanism 11 that includes a sheet-supply roller 37, a pair of stopper members 12 that are provided in a bottom plate 21 of the hopper portion 10 so as to move up and down, a position change mechanism 13 that changes a position of the stopper members 12 between a protruding position and a retracted position, a sheet feed operation mechanism 14 that drives the position change mechanism 13 and the sheet-supply roller 37 at the same time, and a sheet position control device 15 (FIG. 7).

The hopper portion 10, which is made of synthetic resin, includes an inclined wall 20, the bottom plate 21, and side walls 22, 23. The inclined wall 20 holds a stack of sheets in an inclined position. The bottom plate 21 receives lower (leading) edges of the sheets held by the inclined wall 20. The inclined wall 20 and the bottom plate 21 are connected with each other via the side walls 22, 23. A sheet guide plate 24 is detachably attached to an upper portion of the inclined wall 20. A pair of guide members 25, 26 are provided to the inclined wall 20 to guide side edges of the sheets P in a sheet width direction. The guide members 25, 26 are separately and symmetrically provided so as to move in the sheet width direction in synchronization with each other. The structure of the guide members 25, 26 is well known, so that a detail description of the guide members 25, 26 will be omitted.

Figure 2:
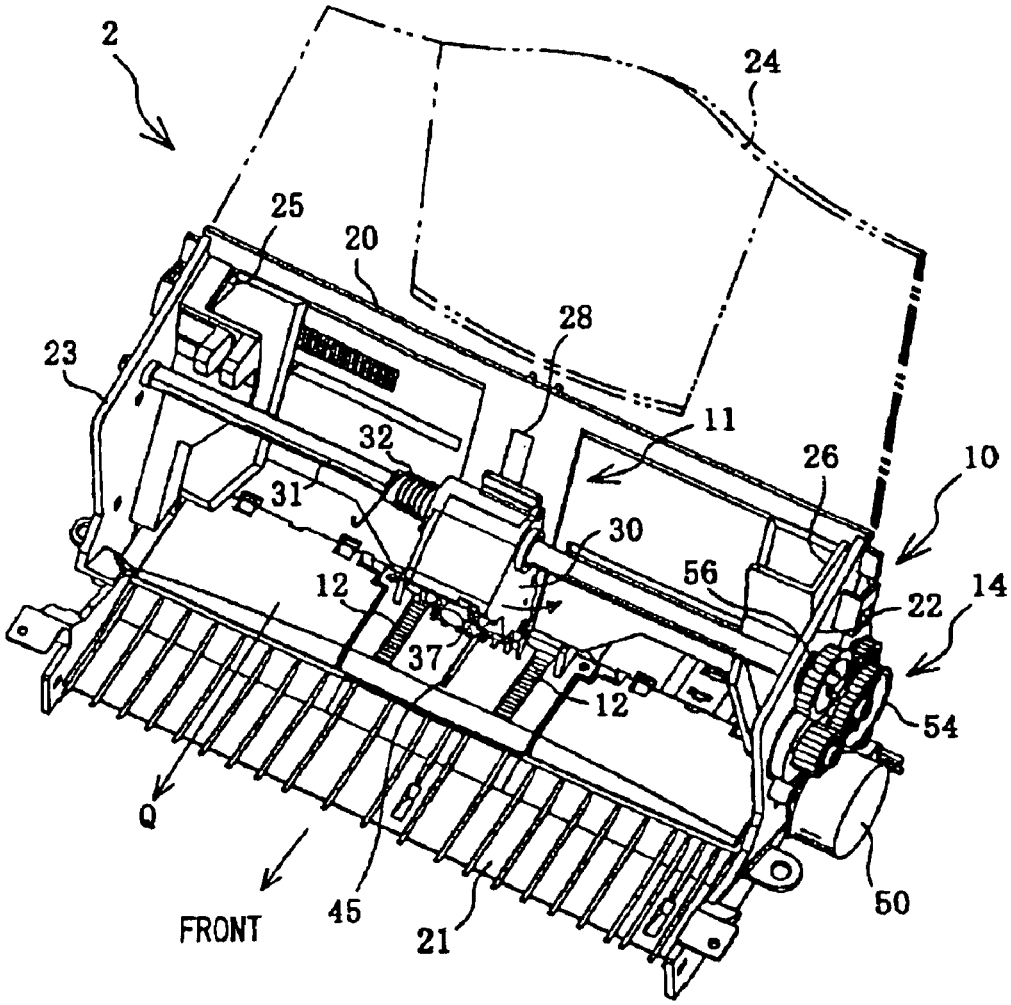
FIG. 2 is a schematic perspective view of a sheet-supply device.
Figure 5:
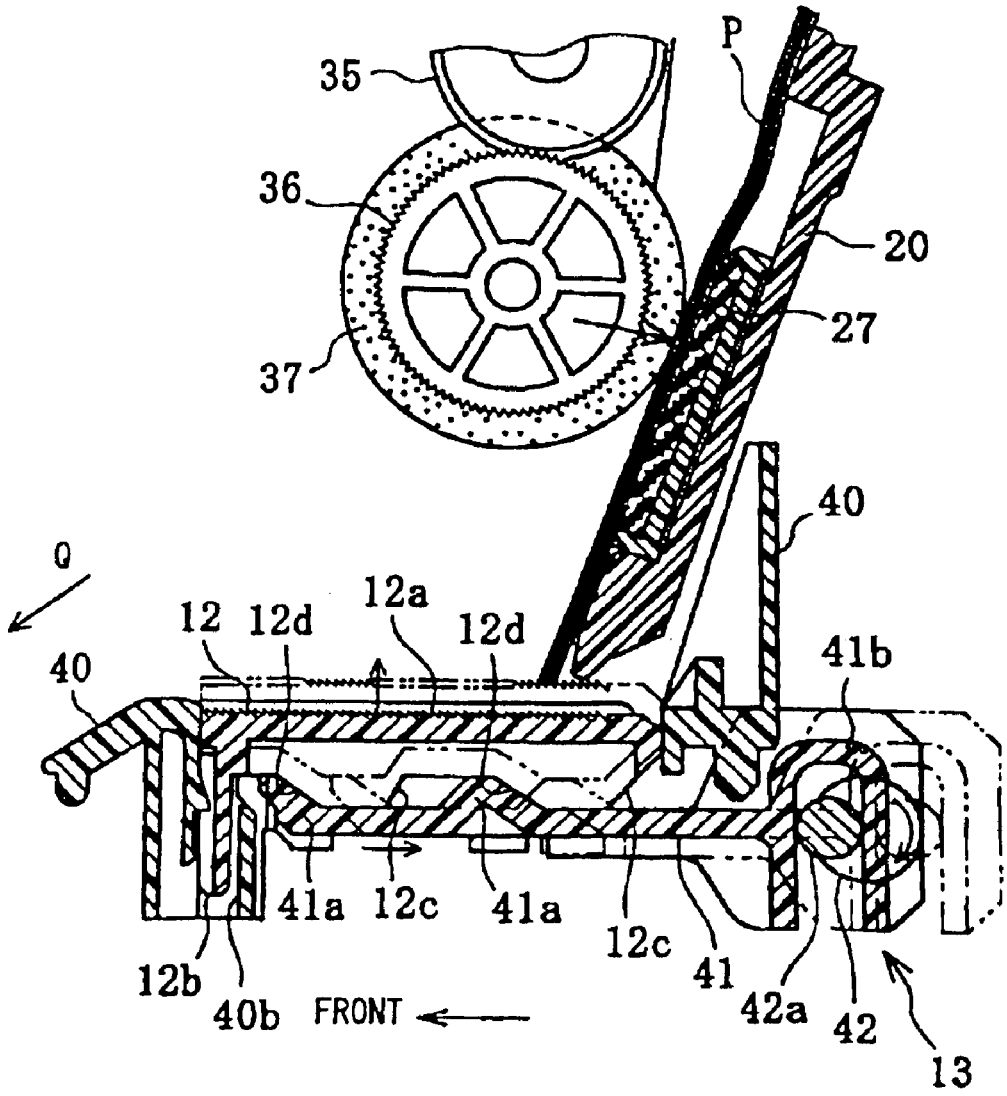
FIG. 5 is a vertical sectional view showing essential parts of the hopper portion and stopper members.
Figure 8:
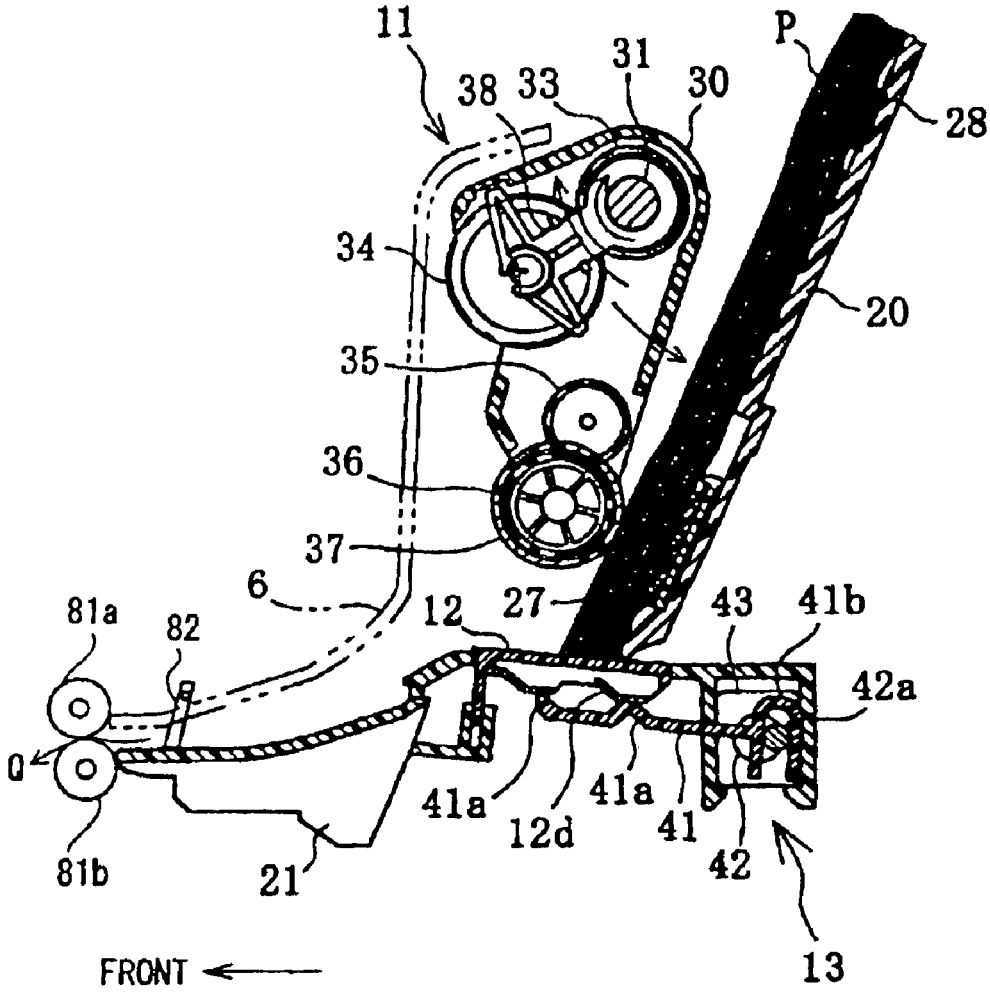
FIG. 8 is a sectional side view showing essential parts of a sheet feed mechanism, a position change mechanism, and the stopper members in a standby state of the sheet-supply device.

A first friction member 27, as shown in FIGS. 5 and 8, which can slide in the up and down directions, is provided at a position corresponding to the sheet-supply roller 37 and near the middle in the right and left direction of the lower end of the inclined wall 20. The first friction member 27 prevents two or more sheets, including a lowermost sheet, from feeding at one time (a multi-feed problem), when an amount of remaining sheets is low. In addition, as shown in FIGS. 2 and 8, a second friction member 28 is provided to the inclined wall 20 at a position higher than the position where the first friction member 27 is provided. The first and second friction members 27, 28, which are made of cork-rubber (the mixture of cork and rubber) having a high coefficient of friction, apply their frictional resistance to a lowermost sheet in the stack of sheets P held by the hopper portion 10, resulting in prevention of the multi-feed problem.

That is, when the amount of remaining sheets P is low, the sheet-supply roller 37 presses the sheets P against the first friction member 27, so that the first friction member 27 can effectively apply frictional resistance to the sheets P. When the amount of remaining sheets P is high, a lowermost sheet P is also pressed against the second friction member 28 under the weight of the sheets P, so that the frictional force of the second friction member 28 can effectively act on the lowermost sheet P. Thus, an avalanche or slippage of the sheets P in the sheet feed direction Q can be prevented.

The sheet feeding mechanism 11 will be described below.

As shown in FIGS. 2 and 8, a sheet feed shaft 31, extending in the right and left direction, is rotatably supported by the side walls 22, 23 at the ends of the sheet feed shaft 31. The sheet feed shaft 31 is inserted into the sheet feed mechanism 11 to support the sheet feed mechanism 11 at a substantially middle portion of the sheet feed shaft 31 in the right and left direction. A spiral spring 32 is externally attached to the sheet feed shaft 31 so that the sheet feed mechanism 11 is elastically urged toward the inclined wall 20 at all times. In the sheet feed mechanism 11, a drive gear 33 fixed to the sheet feed shaft 31, a planet gear 34 engaging the drive gear 33, a following gear 35, and a sheet feed gear 36 engaging the following gear 35 are rotatably provided in a case 30. The sheet feed gear 36 is partially exposed to the outside from the case 30.

The sheet-supply roller 37 made of rubber is integrally fixed to the sheet feed gear 36. Thus, the sheet-supply roller 37 presses the lower portions of the sheets P toward the first friction member 27, i.e. the inclined wall 20, by a force from the spiral spring 32. That is, in the case 30, the drive gear 33 is fixed to the sheet feed shaft 31 and the planet gear 34 engaging the drive gear 33 is rotatably supported by an end of a plate-shaped swing member 38, which is externally inserted into the sheet feed shaft 31 and has a slide resistance with respect to the sheet feed shaft 31. When the planet gear 34 is swung to a lower connecting position (see FIG. 12) by the swing member 38, the planet gear 34 engages the following gear 35.

In FIG. 8, when the sheet feed shaft 31 rotates in a clockwise direction, the swing member 38 swings upward by the rotation of the sheet feed shaft 31, thereby disengaging the planet gear 34 from the following gear 35. When the sheet feed shaft 31 rotates in a counterclockwise direction, the swing member 38 swings downward and the planet gear 34 engages the following gear 35, thereby feeding sheets P, one by one, by the rotation of the sheet-supply roller 37 in the clockwise direction. The sheet-supply roller 37 is elastically urged toward the first friction member 27 at all times by the force from the spiral spring 32. The front of the sheet feed mechanism 11 and the hopper portion 10 is covered with a protection cover 6.

A pair of resist rollers 81 are provided downstream of the bottom plate 21 and the protection cover 6 in the sheet feed direction Q. The pair of resist rollers 81 include a main roller 81*a* that is rotated by a conveyor motor 65 (FIG. 7) and a pressing roller 81*b* that is freely rotatable and opposed to the main roller 81*a*. As described later, the resist rollers 81 align a leading edge of a sheet P fed by the sheet-supply roller 37 and further convey the sheet P to a printing unit (not shown) of the printing device 4.

A resist sensor 82 is provided upstream of the resist rollers 81 to detect a leading edge of a sheet P to be fed to the resist rollers 81.

The pair of the stopper members 12 and the position change mechanism 13 that changes the position of the stopper members 12 will be described with reference to FIGS. 2, 3, and 5.

The bottom plate 21 is provided with a cutaway portion at the middle to place a sheet separating member 40 therein. The sheet separating member 40 is a separated part from the bottom plate 21. Slits 40*a*, extending in the front to rear direction, are formed in the bottom plate 21 and on both side areas of the sheet separating member 40. The stopper members 12 are provided in the slits 40*a*, respectively, so as to move up and down between the protruding position and the retracted position.

Figure 6:
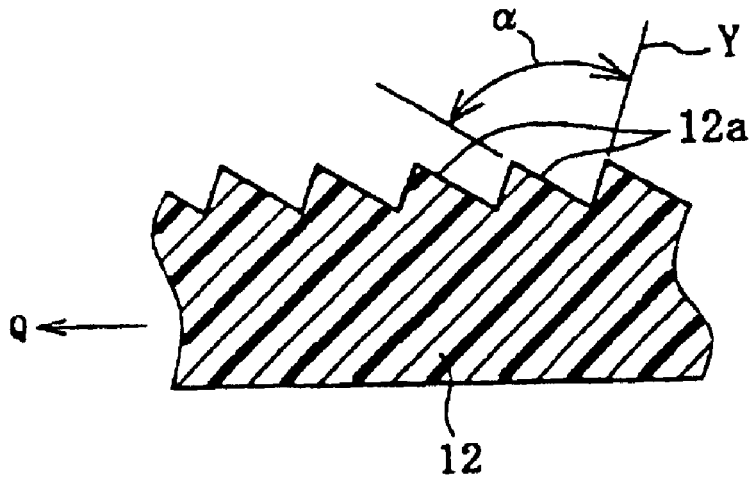
FIG. 6 is a partially enlarged view showing a regulating surface of each of the stopper members.

Each of the stopper members 12 has a saw-toothed regulating surface 12*a* as shown in FIG. 6. The regulating surface 12*a* has a plurality of sawteeth, each of which has a predetermined opening angle $\alpha$ (for example, between 45 to 90 degrees) with respect to a sheet extending direction Y of the sheets P held by the hopper portion 10. With this structure, the stopper members 12 can effectively regulate the lower edges of the sheets P by the regulating surfaces 12*a* so that the lower edges of the sheets P held by the hopper portion 10 do not undesirably move in the sheet feed direction Q from a predetermined sheet holding position. A support portion 12*b* extends downward from the front end of each of the stopper members 12. Each support portion 12*b* is inserted into a support hole 40*b*, which is provided in the front end portion of the sheet separating member 40, so that the stopper members 12 move in the up and down directions.

The stopper members 12 are also supported at their rear end portions so that the stopper members 12 can move in the up and down directions. Each of the stopper members 12 has two projected portions 12*c* that project downward in a form of a trapezoid, wherein one projected portion 12*c* is disposed at the front and another projected portion 12*c* is disposed at the rear. Each of the projected portions 12 has an inclined guide surface 12*d* at the front side. Up-and-down moving members 41, extending in the front to rear direction, are provided under the respective stopper members 12. Each of the up-and-down moving members 41 has front and rear contact portions 41*a*, which contact the respective inclined guide surfaces 12*d* of the projected portions 12*c* from below. Each of the up-and-down moving members 41 has a reverse U-shaped drive portion 41*b* at the rear end.

Figure 3:
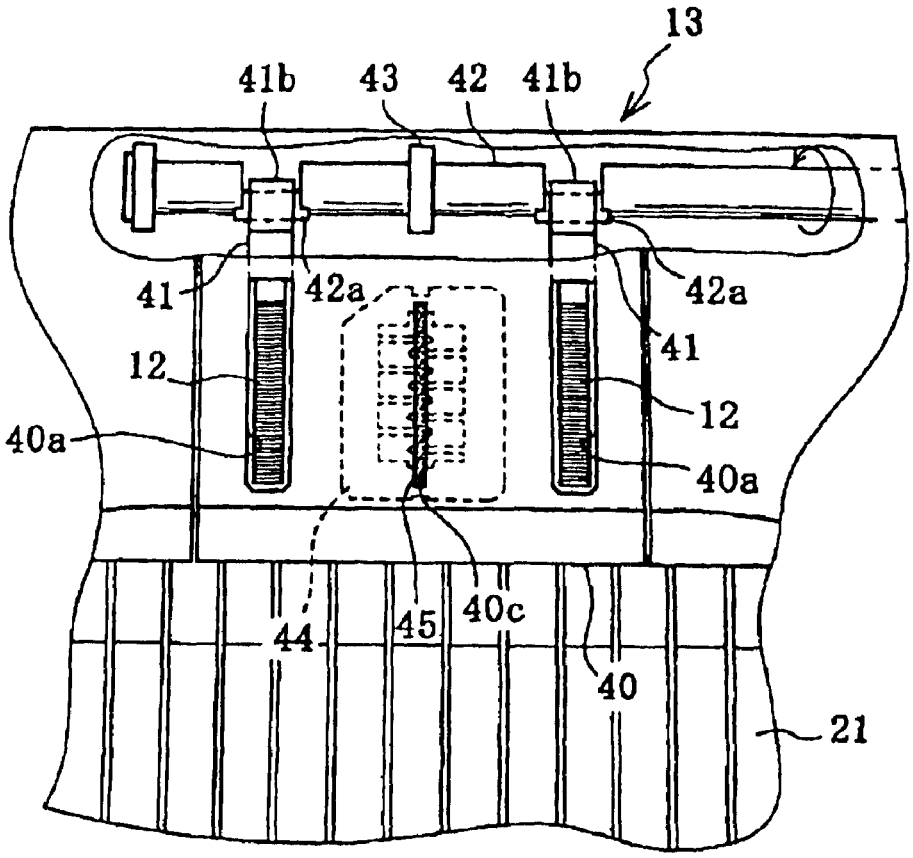
FIG. 3 is a partially cutaway plan view of a bottom plate of a hopper portion.

As shown in FIG. 3, an up-and-down moving shaft 42, extending in the right and left direction, is disposed at immediately rear of the sheet separating member 40. The up-and-down moving shaft 42 is rotatably supported to the bottom plate 21 via support blocks 43 at several positions. Eccentric portions 42*a* having a predetermined width are partially provided at portions corresponding to the stopper members 12. The drive portions 41*b* of the up-and-down moving members 41 are connected to the respective eccentric portions 42*a*. As the up-and-down moving shaft 42 rotates in the clockwise direction, the eccentric portions 42*a* are located at the front position (see FIG. 5) and the contact portions 41*a* contacts the inclined guide surfaces 12*d*, whereby the position of the stopper members 12 is changed to the retracted position.

When the up-and-down moving shaft 42 further rotates (see FIG. 8) and thus the eccentric portions 42*a* move to a rear position, the position of the stopper members 12 is changed to the protruding position via the contact portions 41*a* of the up-and-down moving members 41 and the projected portions 12*c* of the inclined guide surfaces 12*d*. Further, when the up-and-down moving shaft 42 further rotates and the eccentric portions 42*a* return to the front position (see FIG. 10), the position of the stopper members 12 is changed to the retracted position via the contact portions 41*a* of the up-and-down moving member 41 and the projected portions 12*c* of the inclined guide surfaces 12*d*.

The protruding position is a condition where the upper surfaces (the sawtoothed regulating surfaces 12*a*) of the stopper members 12 project approximately 1 mm from the upper surface of the sheet separating member 40. The retracted position is a condition where the upper surfaces (the saw-toothed regulating surfaces 12*a*) of the stopper members 12 lower approximately 1 mm than the upper surface of the sheet separating member 40.

As shown in FIG. 3, a slit 40*c*, extending in the front to rear direction, is provided between the stopper members 12, in the sheet separating member 40. A separating pad 45, which is made of urethane rubber, is provided in the slit 40*c* in order to apply a slide resistance to the sheets P.

Figure 4:
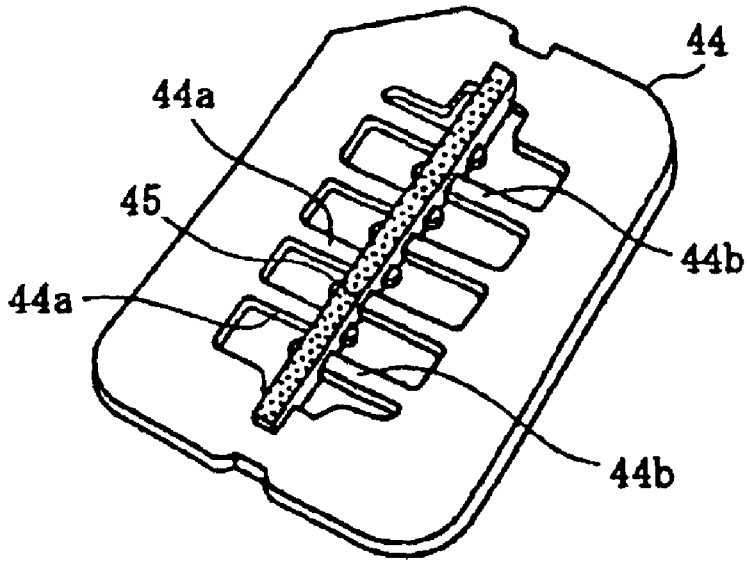
FIG. 4 is a perspective view of a separating pad and a leaf spring member that supports the separating pad.

As shown in FIG. 4, the separating pad 45 is provided to the bottom plate 21, as a lower edge support portion, with being resiliently supported by a leaf spring member 44. A plurality of left support portions 44*a* and right support portions 44*b*, which alternatively protrude inward from respective sides like a comb, resiliently supports the separating pad 45 such that the left and right support portions 44*a*, 44*b* are inserted into the separating pad 45. The separating pad 45 slightly protrudes from the upper surface of the bottom plate 21 at all times. Accordingly, even when the stopper members 12 are located at the retracted position, the movement of the lower edges of the sheets P in the sheet feed direction Q is minimized by the slide resistance applied by the separating pad 45.

The sheet feed operation mechanism 14 will be described with reference to FIGS. 2 and 9.

A sheet feed motor 50 is fixed to an outer surface of the right side wall 22. Four gears 51 to 54, including a drive gear 51 attached to the sheet feed motor 50, are rotatably supported as a drive system. A gear 55 engaging the gear 54, and a gear 56 engaging the gear 55 are also rotatably supported as a sheet feed system. In addition, a gear 58 engaging a planet gear 57, and gears 59, 60 are rotatably supported, as an up-and-down moving system for moving the stopper members 12. The sheet feed shaft 31 and the up-and-down moving shaft 42 are fixed to the gear 56 and the gear 60, respectively.

The gears 53, 54 are compound gears. The gear 53 includes a small-diameter gear 53*a* and a large-diameter gear 53*b*. The gear 54 includes a small-diameter gear 54*a* and a large-diameter gear 54*b*. That is, the gear 52 engages the drive gear 51, the large-diameter gear 53*b* engages the gear 52, and the large-diameter gear 54*b* engages the small-diameter gear 53*a*. A plate-like swing member 61 is provided between the right side wall 22 and the compound gear 54 with the base end of the swing member 61 having a slide resistance. The swing member 61 rotatably supports the planet gear 57 at its free end.

Figure 9:
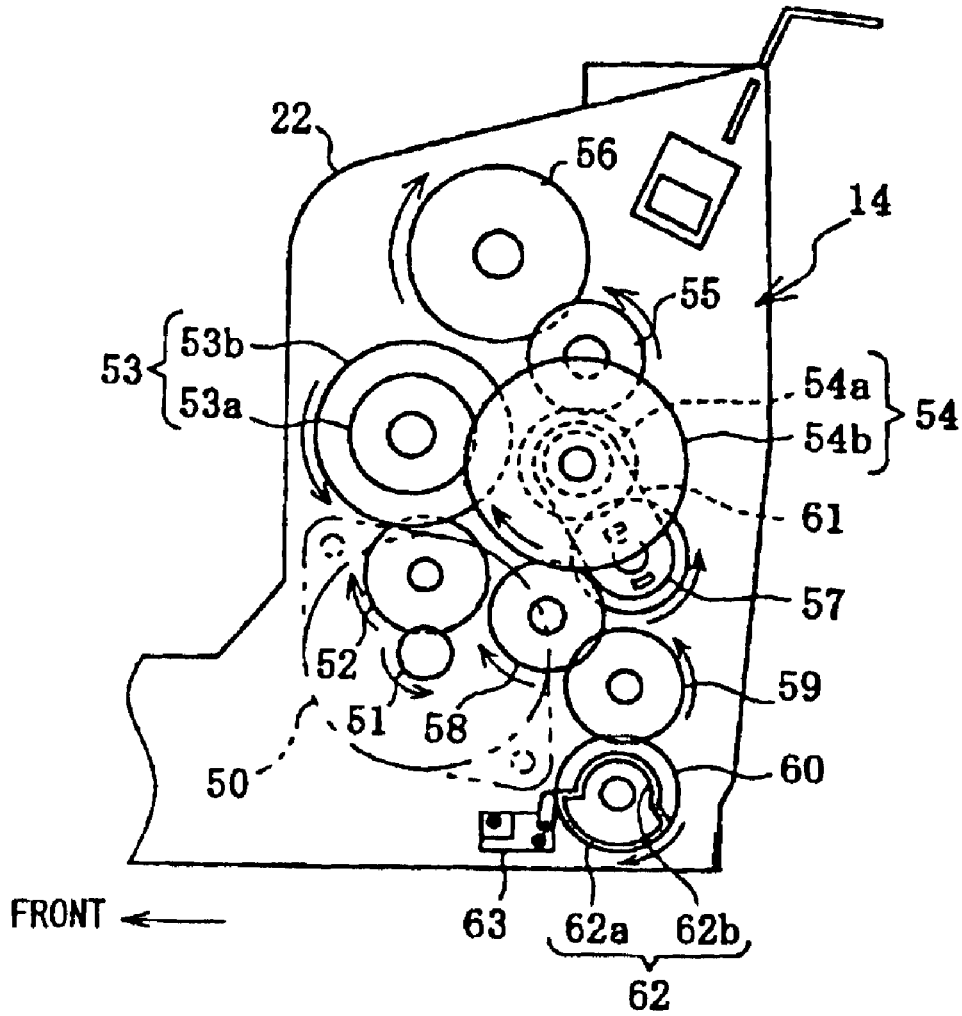
FIG. 9 is a diagram showing an operation of a sheet feed operation mechanism when the stopper members are moved up and down.
Figure 10:
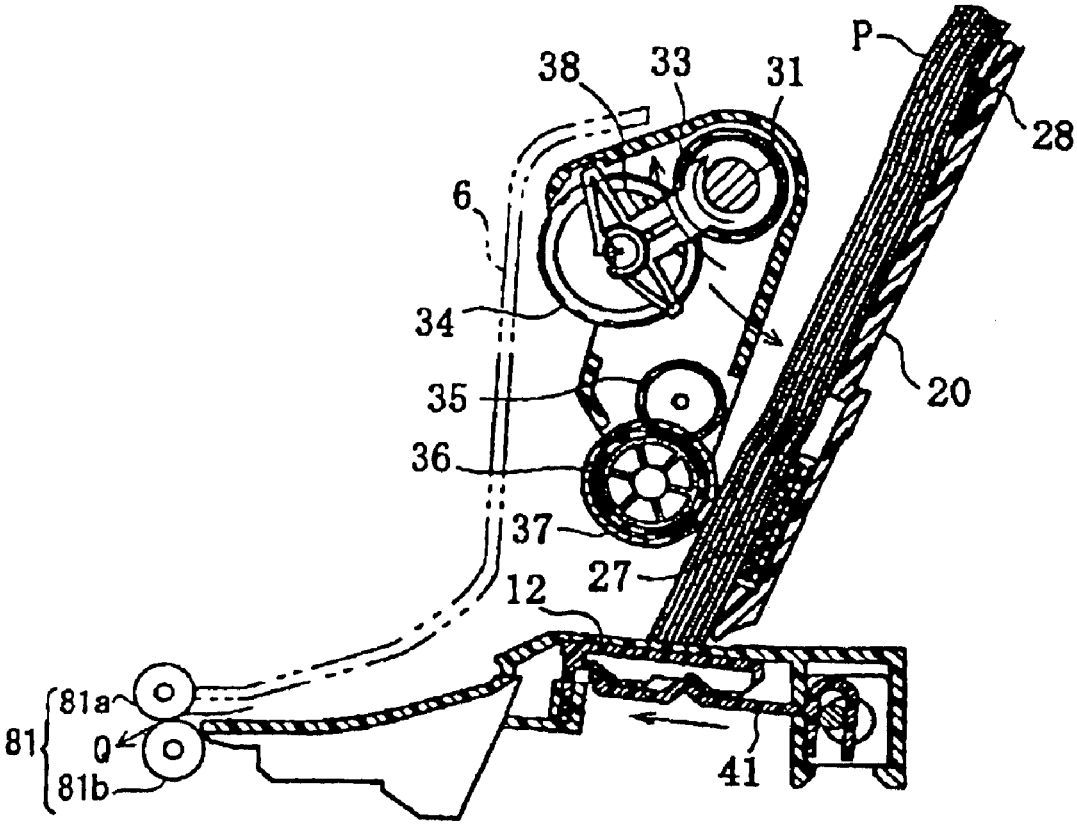
FIG. 10 is a sectional side view showing essential parts of the sheet feed mechanism, the position change mechanism, and the stopper members when the sheet feed operation starts.

When the compound gear 54 rotates in the clockwise direction, the swing member 61 also swings in the same (clockwise) direction and thus the planet gear 57 engages the gear 58 (see FIG. 9). When the compound gear 54 rotates in the counterclockwise direction, the swing member 61 swings in the same (counterclockwise) direction and thus the planet gear 57 disengages the gear 58 (see FIG. 11). As described above, when the sheet feed motor 50 rotates in the counterclockwise direction, that is, in the reverse direction, the up-and-down moving shaft 42 rotates in the clockwise direction via the gears 57 to 60, as shown in FIG. 9. Thus, the stopper members 12 move up and down.

Although the sheet feed shaft 31 rotates in the clockwise direction while the stopper members 12 moves up and down, the sheets P are not fed by the sheet-supply roller 37 because the planet gear 34 is not in engagement with the following gear 35. As the sheet feed motor 50 rotates in the clockwise direction, that is, in a normal direction, from the above condition, the planet gear 57 disengages the gear 58 (see FIG. 11), so that the stopper members 12 do not move up and down. While the stopper members 12 are maintained at the retracted position (FIG. 12), the sheet feed shaft 31 rotates in the counterclockwise direction, so that the planet gear 34 engages the following gear 35 to feed the sheets P, one by one, by the sheet-supply roller 37 via the gears 34 to 36, as described above.

A cam member 62, which has a large-diameter cam portion 62*a* and a small-diameter cam portion 62*b*, is provided at the outside surface of the gear 60, which is the last gear in the up-and-down moving system. A sheet feed switch 63, which outputs an on signal and an off signal in accordance with the large-diameter cam portion 62*a* and the small-diameter cam portion 62*b*, is provided near the cam member 62. That is, when the sheet feed switch 63 contacts the small-diameter cam portion 62*b* from the large-diameter cam portion 62*a*, the sheet feed switch 63 outputs an off signal, which means the stopper members 12 are located at the retracted position. When the sheet feed switch 63 contacts the large-diameter cam portion 62*a* from the small-diameter cam portion 62*b*, the sheet feed switch 63 outputs an on signal, which means the stopper members 12 are located at the protruding position.

The sheet position control device 15 will be described with reference to FIG. 7.

The sheet position control device 15 is a microcomputer that includes a CPU, a ROM, a RAM, and an input and output interface (all not shown). The sheet feed motor 50, the conveyor motor 65, the sheet feed switch 63, a sheet condition detecting unit 67, and the resist sensor 82 are electrically connected with the input-output interface. Therefore, the sheet feed motor 50 and the conveyor motor 65 are controlled by the sheet position control device 15. The sheet condition detecting unit 67 detects a type and an amount of sheets P held by the hopper portion 10 and sends the detected data to the sheet position control device 15. The type and amount of the sheets P can be directly detected or recognized by using an optical sensor or can be detected by reading set values set by a printer driver of the printing device 4.

The sheet position control device 15 aligns a leading edge of a sheet P by the resist rollers 81 before the sheet P is further fed to the printing unit, and regulates lower edges of sheets P by the stopper members 12 so as that the sheets P do not undesirably move in the sheet feed direction Q, as well as positioning the sheets P at a predetermined sheet holding position, in response to outputs provided from the sheet feed switch 63, the sheet condition detecting unit 67 and the resist sensor 82.

Next, operations and effects of the sheet-supply device 2 will be described with reference to FIGS. 8 to 15 and 20A and 20B.

In the multifunctional apparatus 1 of the embodiment, the type of sheets P held by the hopper portion 10 is detected and a suitable sheet feed operation is determined (performed) in accordance with the type of the sheets P. More specifically, first, it is determined, in the printer driver of the printing device 4, whether use of matte sheets for inkjet printer is selected or use of other type of sheets is selected, by reading a set value indicating the type of the sheets to be used in a selected print mode (S100). When the use of the matte sheets for ink-jet printer is selected, a sheet feed operation of S300 to S395 is performed. When the use of the other type of sheets is selected, a sheet feed operation of S200 to S280 is performed.

Hereinafter, descriptions will be given below, assuming that the use of the other type of sheets is selected at Step 100.

As shown in FIG. 8, a stack of sheets P are held by the hopper portion 10. In this state, the sheet-supply roller 37 presses a topmost sheet P toward the sheets P, that is, the inclined wall 20 of the hopper portion 10, at all times regardless of the amount of sheets held by the hopper portion 10. The gears 51 to 60 in the drive system and the sheet feed system are at a standstill in a rotation phase shown in FIG. 9. The stopper members 12 are located at the protruding position. In this state, until the sheet feed operation starts, a resistance is applied to the movement of the lower edges of the sheets P held by the hopper portion 10 by the saw-toothed regulating surfaces 12*a* of the stopper members 12 positioned at the protruding position. Accordingly, the sheets P are prevented from moving in the sheet feed direction Q while the sheet feed operation is not performed.

Only when the stopper members 12 are positioned at the retracted position, a slide resistance is applied to the lower edges of the middle areas of the sheets P by the separating pad 45. When the sheet-supply device 2 starts a sheet feed operation in response to a print signal instructing the multifunctional apparatus 1 to perform a printing operation (S200), first, as shown in FIG. 9, the sheet position control device 15 rotates the sheet feed motor 50 in the reverse direction (the counterclockwise direction in FIG. 9) (S210) in order to descend the stopper members 12 to the retracted position by rotating the up-and-down moving shaft 42 in the clockwise direction, because the sheet feed switch 63 outputs an on signal as the stopper members 12 are located at the protruding position. By doing so, the stopper members 12 are gradually descended to the retracted position (see FIG. 10).

Figure 11:
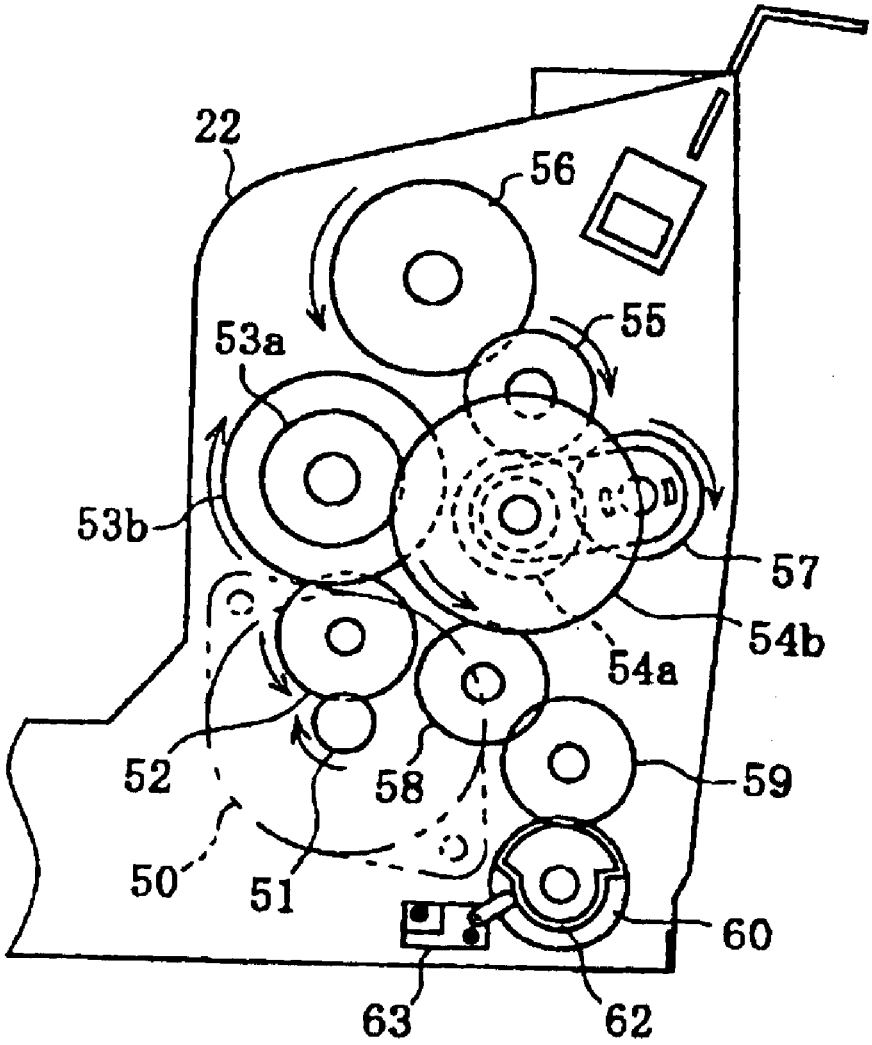
FIG. 11 is a diagram showing an operation of the sheet feed operation mechanism when the sheet feed operation starts.
Figure 12:
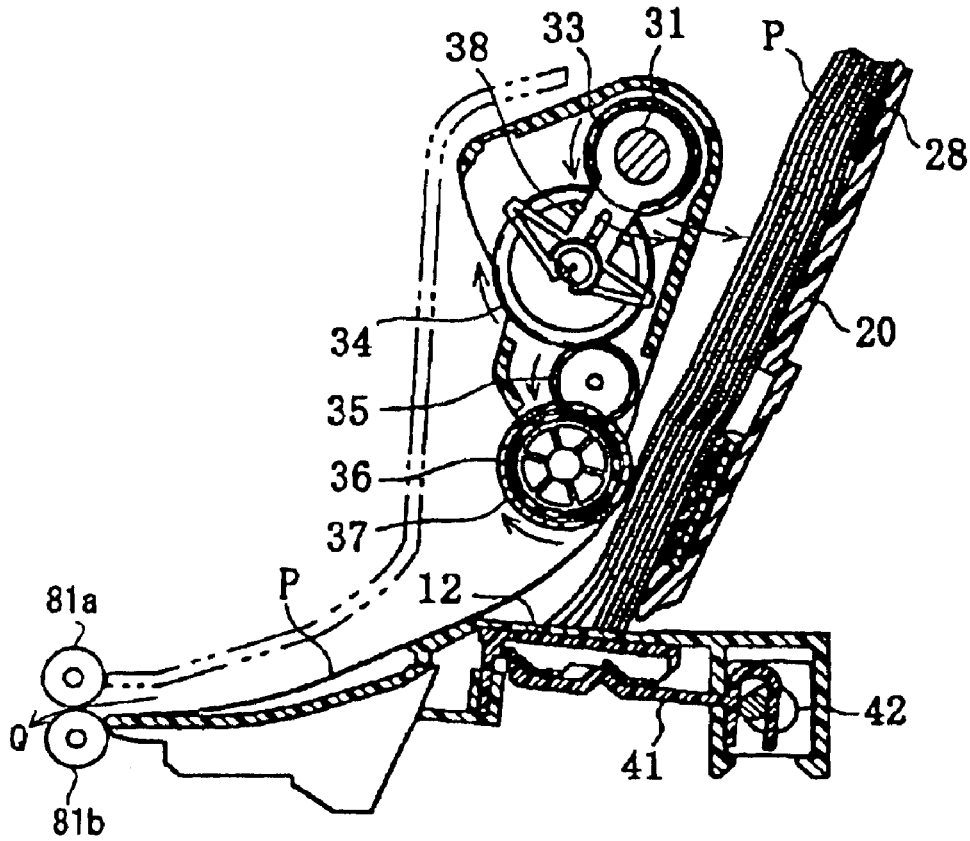
FIG. 12 is a sectional side view showing essential parts of the sheet feed mechanism, the position change mechanism, and the stopper members in process of the sheet feed operation.

Then, when the sheet feed switch 63 outputs an off signal and it is detected that the stopper members 12 reaches the retracted position, the sheet feed motor 50 stops driving (S220:YES). Thereafter, the sheet position control device 15 rotates the sheet feed motor 50 in the normal (counterclockwise) direction, as shown in FIG. 11 (S230) to rotate the sheet feed shaft 31 in the counterclockwise direction. Thus, the planet gear 34 engages the following gear 35, whereby a topmost sheet P is supplied by the rotation of the sheet-supply roller 37, as shown in FIG. 12. While the topmost sheet P is being fed, both of the stopper members 12 are located at the retracted position, so that the sheet P can be smoothly fed by the sheet-supply roller 37. During the sheet feed operation, the rest of the sheets P held by the hopper potion 10 are prevented from being fed in the sheet feed direction Q, together with the topmost sheet P, by the slide resistance applied by the separating pad 45 even though the stopper members 12 are located at the retracted position.

The sheet-supply roller 37 continues rotating until the resist sensor 82 detects the leading edge of the fed sheet P (S250). When the sheet feed operation starts by rotating the sheet-supply roller 37, the sheet position control device 15 drives the conveyor motor 65 causing the main roller 81*a* of the pair of resist rollers 81 to rotate in the reverse direction opposite to the sheet feed direction (S240).

After that, when the resist sensor 82 detects the leading edge of the fed sheet P, the sheet position control device 15 rotates the sheet feed motor 50 in the normal (clockwise) direction by a predetermined amount from the point where the resist sensor 82 detects the leading edge of the fed sheet P (S260). The predetermined amount is a drive amount of sheet feed motor 50 which brings the fed sheet P in a condition that the sheet P is slightly bent between the sheet-supply roller 37 and the pair of resist rollers 81 by holding the sheets P by the pair of resist rollers 81 rotating in the reverse direction after the leading edge of the fed sheet P reaches the pair of resist rollers 81 provided in the printing device 4 by the rotation of the sheet-supply roller 37.

By driving the sheet feed motor 50 by the predetermined amount, the leading edge portion of the fed sheet P aligns with a line extending from a nipping area formed by the pair of resist rollers 81. That is, a deviation of the sheet is corrected by relieving the deviation caused by the bent sheet P even when the sheet P reaches the pair of resist rollers 81 in a deviated position.

Figure 13:
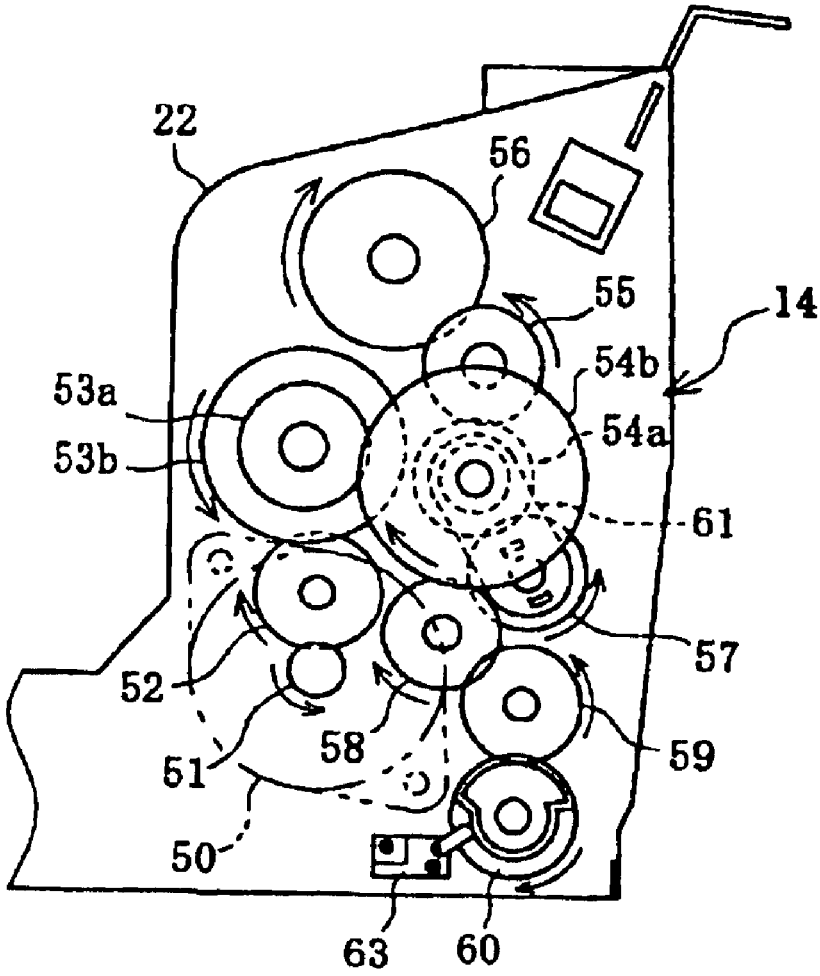
FIG. 13 is a diagram showing the sheet feed operation mechanism when the stopper members are ascended.

After the sheet feed motor 50 is driven by the predetermined amount as described above, the rotation of the sheet feed motor 50 is stopped and thus the sheet feed operation temporarily is stopped. After that, the conveyor motor 65 is driven to rotate the main roller 81*a* in the normal direction, whereby the sheet P is further conveyed to the printing unit of the printing device 4 by the resist rollers 81 (S270). Concurrently with the sheet conveyance by the resist rollers 81, the sheet feed motor 50 starts rotating in the reverse direction. Then, as shown in FIG. 13, the sheet feed motor 50 is continued rotating in the reverse direction until the sheet feed switch 63 outputs an on signal and it is detected that the stopper members 12 reach the protruding position. As described above, the position of both of the stopper members 12 are changed to the protruding position at the same time (S280). With this operation, the rest of the sheets P held by the hopper portion 10 are regulated by the regulating surfaces 12*a* of the stopper members 12, so that the sheets P do not move undesirably in the sheet feed direction Q.

Figure 14:
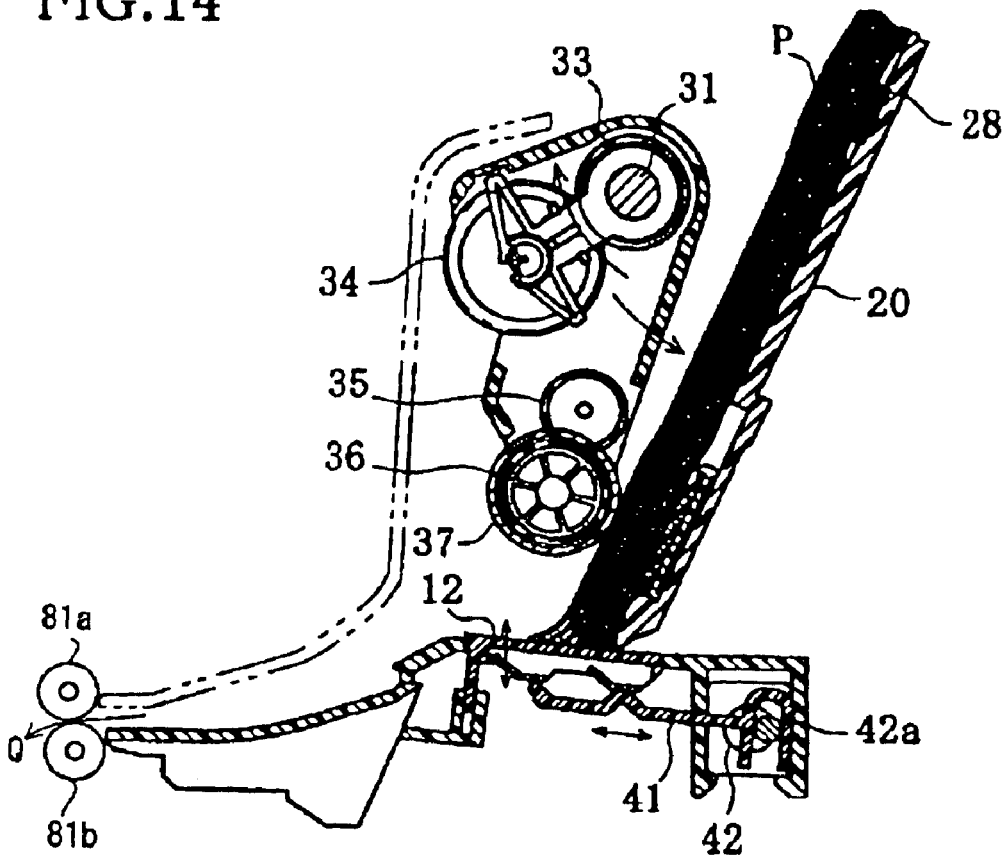
FIG. 14 is a sectional side view showing essential parts of the sheet feed mechanism, the position change mechanism, and the stopper members when the stopper members are moved up and down several times.
Figure 15:
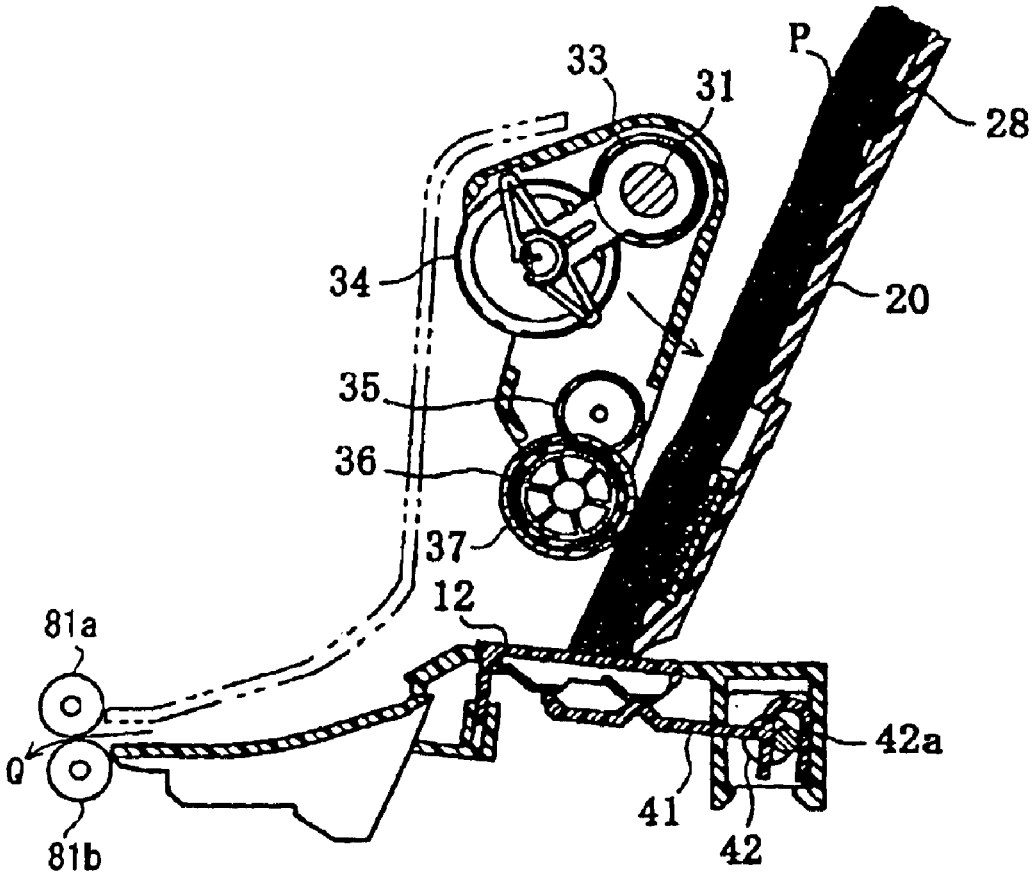
FIG. 15 is a sectional side view showing essential parts of the sheet feed mechanism, the position change mechanism, and the stopper members in a condition where sheets are positioned at a predetermined sheet holding position.
Figure 16:
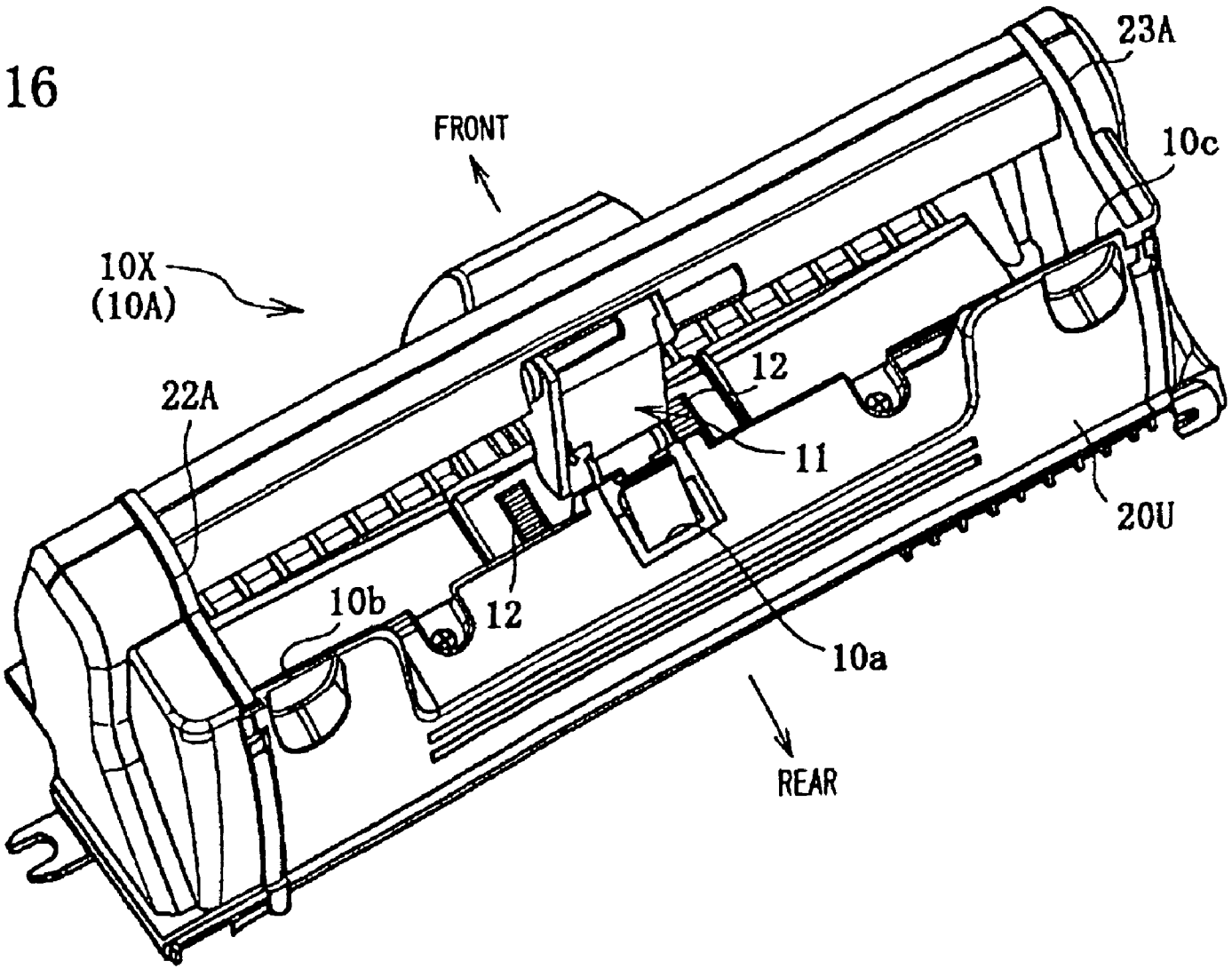
FIG. 16 is a rear perspective view of a hopper portion according to a variation of the embodiment.
Figure 17:
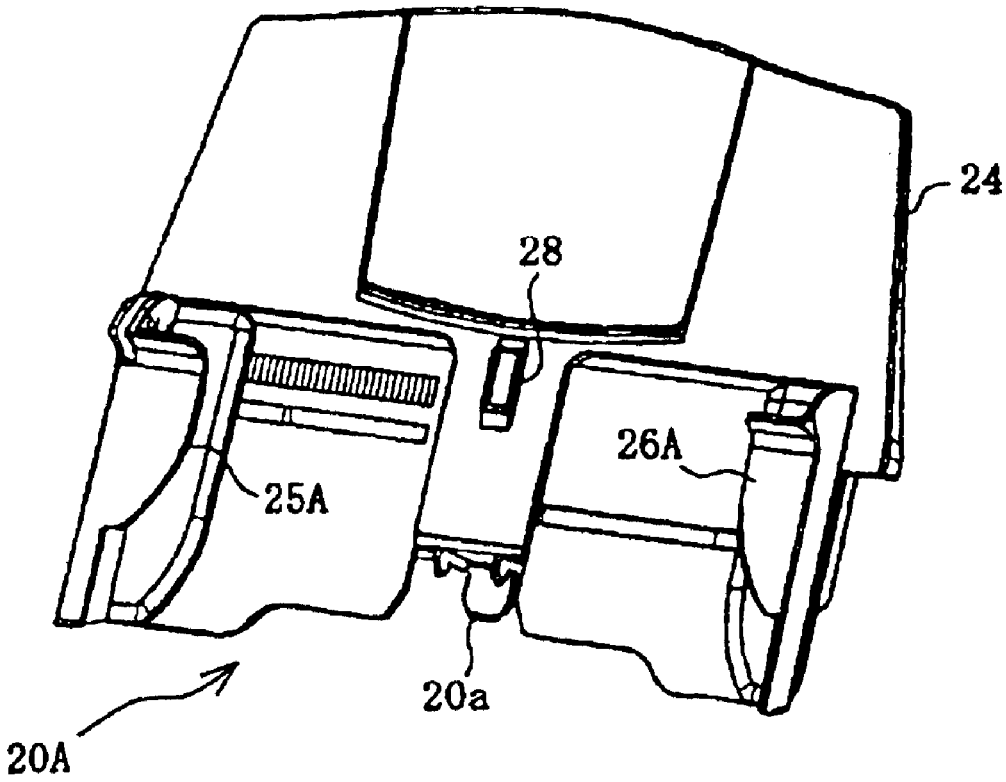
FIG. 17 is a front perspective view of an inclined wall of the hopper portion.
Figure 18:
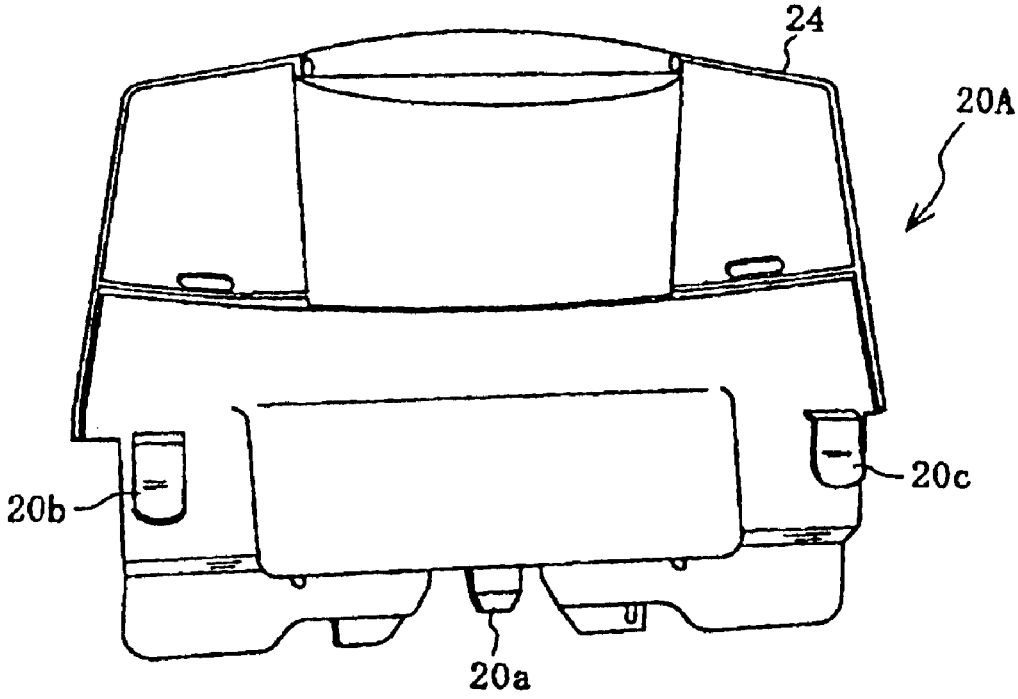
FIG. 18 is a rear perspective view of the inclined wall of the hopper portion.

However, as shown in FIG. 14, there may be a case where a sheet P to be fed next and the rest of the sheets P are displaced to some extent in the sheet feed direction Q from the predetermined sheet holding position after the feeding of the topmost sheet P is completed. This situation is likely to cause the multi-feed problem at a next sheet feed operation. In order to avoid the occurrence of the multi-feed problem, the sheet position control device 15 rotates the sheet feed motor 50 in the reverse direction by the predetermined amount. By doing so, the up-and-down moving member 41 moves in the front and rear directions, and thus the stopper members 12 moves up and down at least once. As a result, the sheets P are gradually pushed back toward the inclined wall 20 by the regulating surfaces 12*a* when the stopper members 12 ascend from the retracted position because the regulating surfaces 12*a* of the stopper members 12 have surfaces slopping in a direction reverse to the sheet feed direction Q and the sheet-supply roller 37 is elastically urged toward the sheets P (the inclined wall 20 of the hopper portion 10). With this operation, the sheets P displaced in the sheet feed direction Q are positioned at the predetermined sheet holding position every time the stopper members 12 move up and down between the protruding position and the retracted position, as shown in FIG. 15. Consequently, the occurrence of the multi-feed problem can be prevented at a next sheet feed operation.

Hereinafter, descriptions will be given, assuming that the use of sheets P for ink-jet printer is selected at S100.

When the sheet-supply device 2 starts a sheet feed operation in response to a print signal instructing the multifunctional apparatus 1 to perform a printing operation (S300), first, as shown in FIG. 9, the sheet position control device 15 rotates the sheet feed motor 50 in the reverse direction (the counterclockwise direction in FIG. 9) (S310) in order to descend the stopper members 12 to the retracted position (S320:YES). Then, the sheet position control device 15 rotates the sheet feed motor 50 in the normal (clockwise) direction, by the predetermined amount (S330), so that the sheet-supply roller 37 rotates by the predetermined amount. As described above, when a topmost sheet P is supplied by the sheet-supply roller 37 rotating by the predetermined amount, the leading edge of the sheet P passes the stopper members 12, which are positioned at the retracted position for starting the sheet feed operation.

As the leading edge of the sheet P passes the stopper members 12, the rotation of the sheet feed motor 50 is stopped in the normal direction to temporarily stop the sheet feed operation. Then, the sheet feed motor 50 is rotated in the reverse direction (S340) to ascend the stopper members 12 to the protruding position (S350:YES). After the stopper members 12 reach the protruding position, the sheet feed motor 50 is rotated in the normal position again to restart the sheet feed operation by the sheet-supply roller 37.

With this operation, the rest of the sheets P, including a sheet to be fed next, are strongly regulated by the regulating surfaces 12 of the stopper members 12, so that the sheets P do not move undesirably in the sheet feed direction Q. In the above situation, the stopper members 12 stay at the retracted position only for a short time during the sheet feed operation, so that the rest of the sheets P held by the hopper portion 10 are less likely to move in the sheet feed direction Q, thereby preventing the multi-feed problem at next sheet feed operation.

The sheet-supply roller 37 continues rotating until the resist sensor 82 detects the leading edge of the fed sheet P (S380). When the sheet feed operation starts by rotating the sheet-supply roller 37, the sheet position control device 15 drives the conveyor motor 65 and thus the main roller 81*a* of the pair of resist rollers 81 rotates in the direction reverse to the sheet feed direction (S370).

After that, when the resist sensor 82 detects the leading edge of the fed sheet P (S380:YES), the sheet position control device 15 rotates the sheet feed motor 50 in the normal (clockwise) direction by the predetermined amount from the point where the resist sensor 82 detects the leading edge (S390). By driving the sheet feed motor 50 by the predetermined amount, the leading edge portion of the fed sheet P aligns with a line extending from a nip area formed by the pair of resist rollers 81. That is, a deviation of the sheet is corrected by relieving the deviation by the bent even when the sheet P reaches the pair of resist rollers 81 with being deviated.

After the sheet feed motor 50 is driven by the predetermined amount as described above, the rotation of the sheet feed motor 50 is stopped and thus the sheet feed operation is temporarily stopped. After that, the conveyor motor 65 is driven to rotate the main roller 81*a* in the normal direction, whereby the sheet P is further conveyed to the printing unit of the printing device 4 by the resist rollers 81 (S395).

However, in this series of the sheet feed control (S300 to S395), there may be a case where a sheet P to be fed next and the rest of the sheets P are displaced to some extent in the sheet feed direction Q from the predetermined sheet holding position at the time of separating the topmost sheet P from the stack (S340). This situation is likely to cause the multi-feed problem at a next sheet feed operation. In order to avoid the occurrence of the multi-feed problem, the operations performed at S340 and S350 may be changed such that the sheet position control device 15 rotates the sheet feed motor 50 in the reverse direction by the predetermined amount so that the stopper members 12 move up and down several times. As a result, the sheets P are gradually pushed back toward the inclined wall 20 by the regulating surfaces 12*a* when the stopper members 12 ascend from the retracted position, because the regulating surfaces 12*a* of the stopper members 12 have surfaces slopping in a direction reverse to the sheet feed direction Q and the sheet-supply roller 37 is elastically urged toward the sheets P (the inclined wall 20 of the hopper portion 10). With this operation, the sheets P displaced in the sheet feed direction Q are surely positioned at the predetermined sheet holding position every time the stopper members 12 move up and down between the protruding position and the retracted position. Consequently, the occurrence of the multi-feed problem can be prevented at a next sheet feed operation.

Variations of the embodiment of the invention will be described below. The same parts are designated by similar reference numerals.

In the sheet positioning operation, wherein leading edges of sheets P are jogged by ascending and descending (moving up and down) the stopper members 12 after a sheet feed operation is completed, the number of times the stopper members 12 move up and down can be determined in accordance with a type of sheets to be used. More specifically, when sheets having a high frictional resistance between sheets, such as matte sheets for inkjet printer, are to be used, the number of times of the up-and-down movement of the stopper members 12 is set to high, and when sheets having a low frictional resistance between sheets or rigid sheets are to be used, the number of times of the up-and-down movement is set to low. By doing so, when the sheets, which are less likely to cause the multi-feed problem, are used, the sheet feed operation can be simplified, thereby saving a time required for a printing operation.

When sheets, which have a low frictional resistance between sheets and are less likely to cause the multi-feed problem, such as sheets whose surfaces are applied with a special coat, are used, it is not necessary for the stopper members 12 to be moved up and down every time after one sheet is fed, but the stopper members 12 may be moved after every the predetermined number of sheets are fed, for example, after every five sheets are fed.

The stopper members 12 may be moved up and down to jog the leading edges of the sheets P immediately before a sheet feed operation starts, but not when a sheet feed operation is finished.

Further, the sheet positioning operation may be performed both at a time before a sheet feed operation starts and at a time after a topmost sheet P passes the stopper members 12 when sheets which are highly likely to cause the multi-feed problem are used.

Although, in the above variations of the embodiment, the up-and-down movement control for the stopper members 12 is determined in accordance with the type of sheets to be used, the control can be determined in accordance with an amount of sheets held by the hopper portion 10. More particularly, when the amount of sheets is high, the number of times the stopper members 12 are moved up and down or a frequency of the up-and-down movement after the sheet feed operation is set to high. When the amount of sheets is low, the number of times the stopper members 12 are moved up and down or a frequency of the up-and-down movement is set to low. Generally, a higher amount of sheets P are more likely to cause the multi-feed problem. Therefore, by determining the control according to the amount of sheets, the sheet feed operation can be simplified and its efficiency can be increased, as well as saving a time required for the printing operation when the amount of sheets P is low, as compared with performing a uniform control.

Further, in accordance with the amount of sheets, a timing of changing the position of stopper members 12 to the protruding position during the sheet feed operation using the sheet-supply roller 37 can be determined. More specifically, when the amount of sheets is high, the stopper members 12 are ascended to the protruding position at an early timing, and when the amount of sheets is low, the stopper members 12 are changed to the protruding position at a late timing, during the sheet feed operation by the sheet-supply roller 37.

Furthermore, the up-and-down movement control of the stopper members 12 can be determined in accordance with both the type and amount of sheets to be used.

The up-and-down moving members 41 for moving the stopper members 12 up and down may be moved electrically and directly by an actuator, such as a solenoid. By doing so, it becomes unnecessary to perform the up-and-down movement of the stopper members 12 by rotating the sheet feed motor 50 in the reverse direction. Therefore, the sheet feed operation using the sheet-supply roller 37 and the up-and-down movement of the stopper members 12 can be separately controlled by separate systems.

As shown in FIGS. 16 to 19, a hopper portion 10A maybe constituted of a hopper body 10X and a unitary inclined wall 20A. The hopper body 10X includes a bottom plate 21A, a lower end 20U of an inclined wall and side walls 22A, 22*b*. The unitary inclined wall 20A has the inclined wall having a pair of guide members 25A, 26A. A plurality of engaged portions 10*a* to 10*c* may be provided at a rear end of the hopper portion 10X, and a plurality of engaging portions 20*a* to 20*c*, which can connect the engaged portions 10*a* to 10*c*, respectively, may be provided at corresponding positions of the unitary inclined wall 20A.

Figure 19:
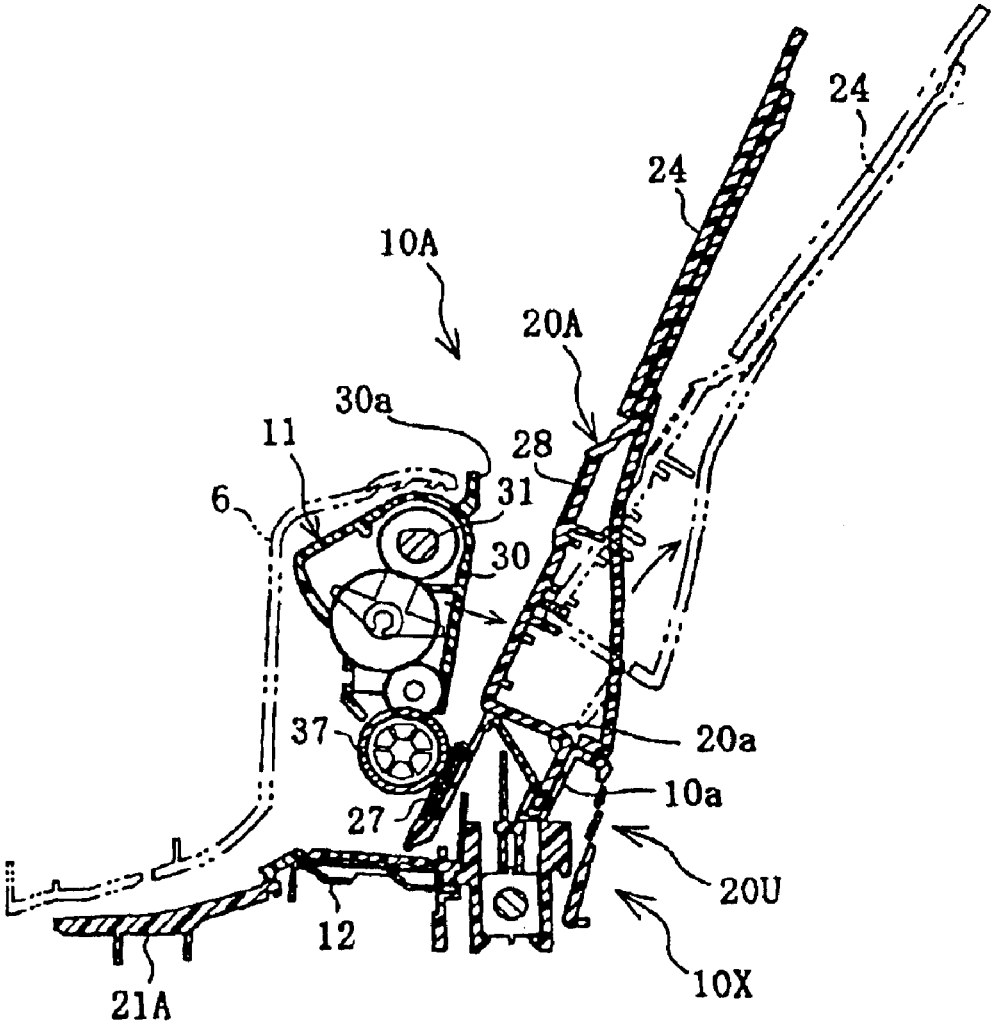
FIG. 19 is a sectional side view showing essential parts of the sheet feed mechanism, the position change mechanism, and the stopper members, including the hopper portion of the variation of the embodiment.
Figure 20A:
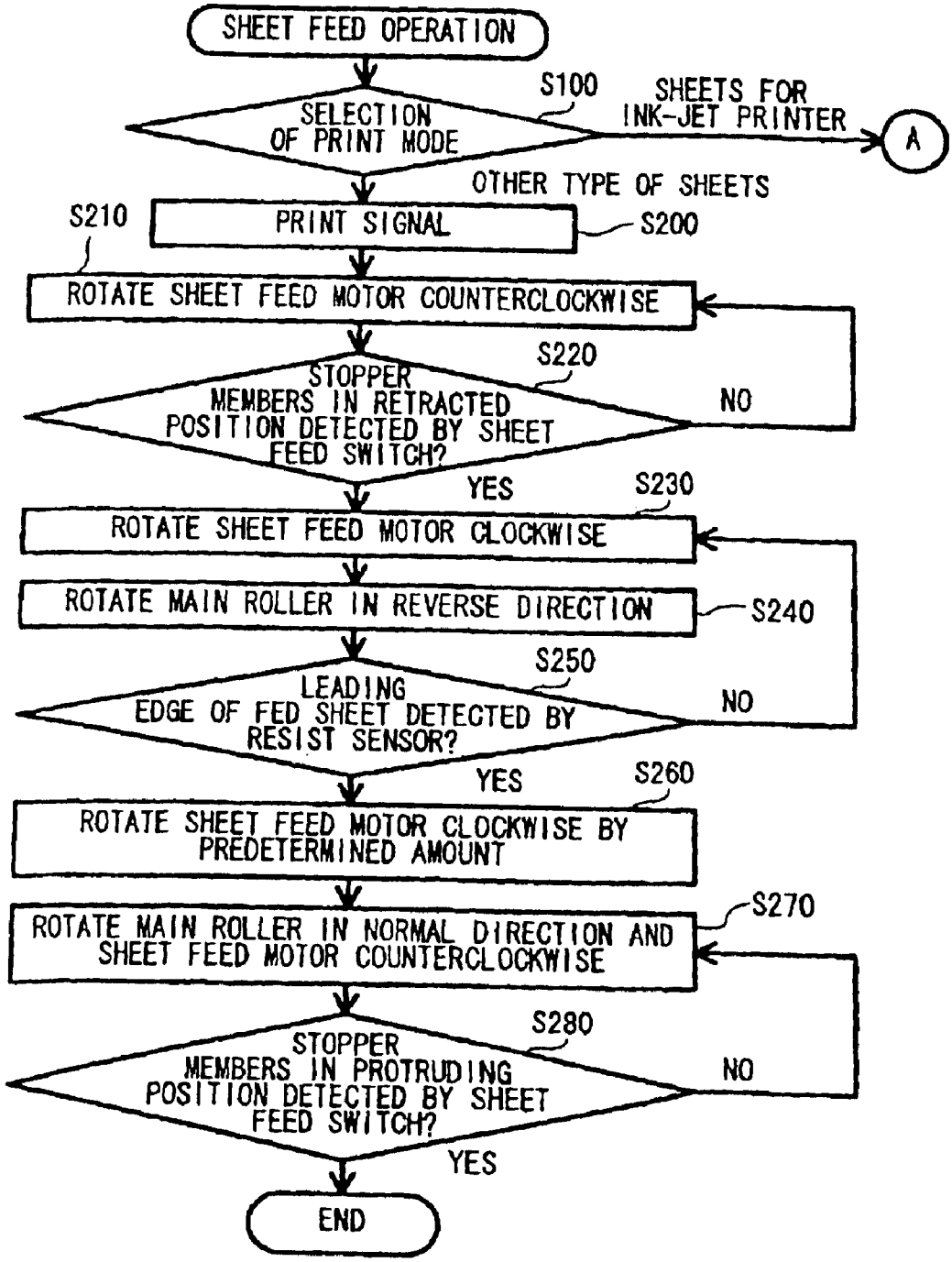
FIG. 20A is a flowchart of the sheet feed operation performed by the sheet-supply device.
Figure 20B:
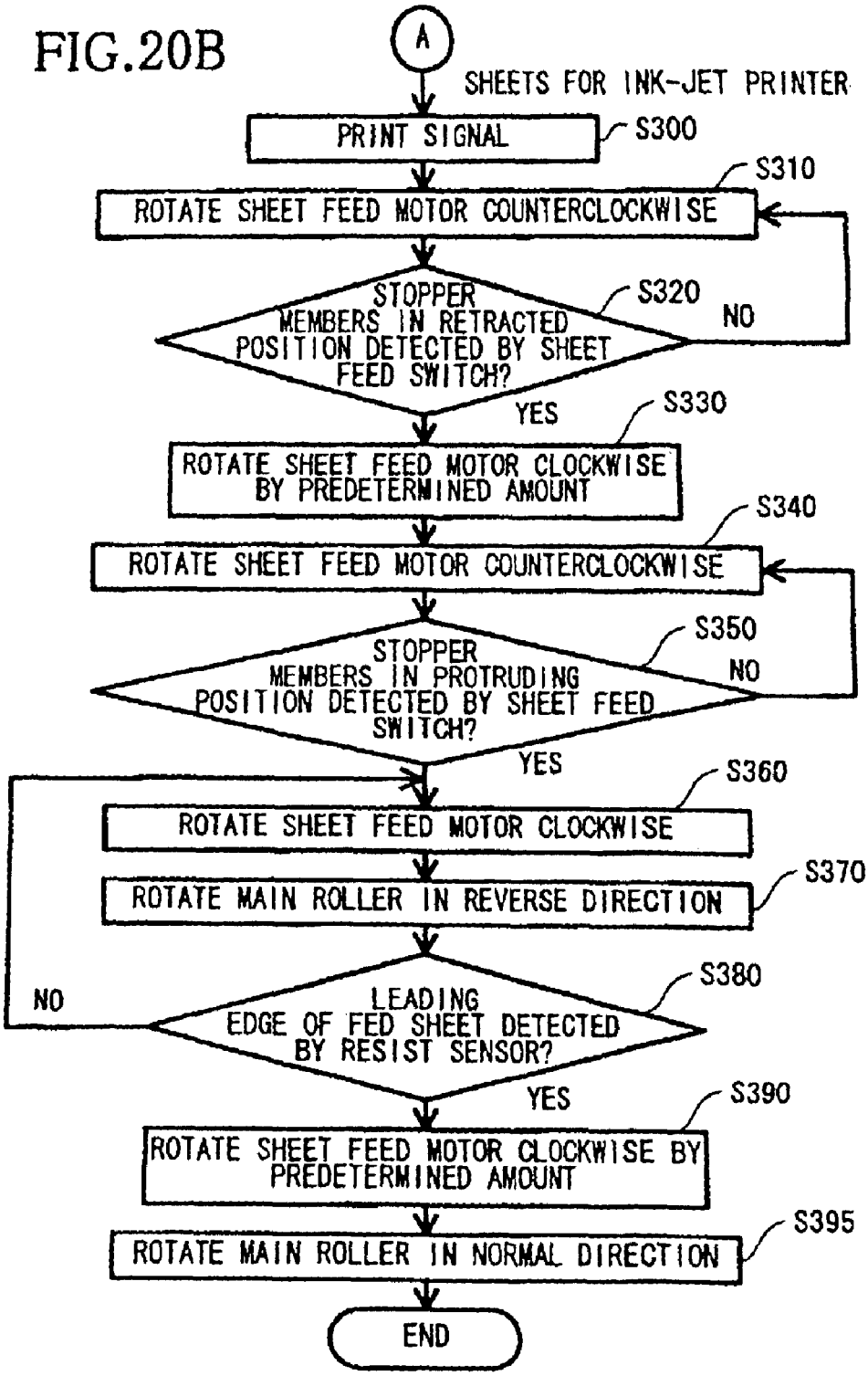
FIG. 20B is a continuation of the flowchart of FIG. 20A.

For the normal sheet feed operation, as shown in FIG. 19, the hopper portion 10X and the unitary inclined wall 20A are integrally connected with each other by engaging the engaging portions 20*a* to 20*c* of the inclined wall 20A with the engaged portions 10*a* to 10*c* of the hopper portion 10X, respectively. The plurality of sheets P are loaded on the hopper portion 10X and can be fed one by one. For example, when a paper jam occurs by which a fed sheet P is caught in a sheet feed path and thus the sheet feed operation is stopped, the sheet P can be easily removed from the hopper portion 10X, because the unitary inclined wall 20A can be removed from the hopper portion 10X (see FIG. 19). Accordingly, the troubleshooting of the paper jam is simplified.

In FIG. 19, when a paper jam occurs in the sheet-supply device 2 before a sheet P reaches the resist rollers 81, a user pinches and rotates a projection 30*a*, extending upward at the upper end of the case 30, by his/her fingers in the clockwise direction against the force from the coil spring 32 to move the sheet-supply roller 37 away from the sheet P. By doing so, the jammed sheet P can be easily removed from the sheet-supply device 2 from the rear.

While the invention has been described in detail with reference to the specific embodiment thereof, it would be apparent to those skilled in the art that various changes, arrangements and modifications may be applied therein without departing from the spirit and scope of the invention.

What is claimed is:

1. A sheet-supply device for supplying sheets, one by one from a stack of sheets, in a sheet feed direction, the sheet-supply device comprising:

a hopper portion that has an inclined wall for holding the stack of sheets in an inclined position and a lower edge receiving portion capable of receiving lower leading edges of sheets that form the stack of sheets;

a sheet feed mechanism that includes a sheet-supply roller which separates and feeds a topmost sheet from the stack of sheets held by the hopper portion;

a stopper member that is provided to a bottom plate of the hopper portion so that a position of the stopper member can be changed between a protruding position where the stopper member protrudes from an upper surface of the bottom plate and a retracted position where the stopper member retracts below the upper surface of the bottom plate, and applies a resistance to movement of the sheets in the sheet feed direction;

a position change mechanism that changes the position of the stopper member between the protruding position and the retracted position and changes the position of the stopper member from the protruding position to the retracted position at least when a sheet feed operation is performed by the sheet-supply roller; and a position change control device that controls the up-and-down movement of the stopper member in accordance with a condition of the sheets held by the hopper portion.

2. The sheet-supply device according to claim 1, further comprising a sheet feed operation mechanism that drives the position change mechanism and the sheet-supply roller in synchronization with each other, thereby changing the position of the stopper member to the retracted position via the position change mechanism when the sheet feed operation using the sheet-supply roller starts.

3. The sheet-supply device according to claim 1, further comprising a separating pad that is a part of the lower edge receiving portion of the hopper portion and applies a slide resistance to the movement in the sheet feed direction of the lower edges of the sheets held by the hopper portion, wherein the stopper member includes a pair of stopper members provided at positions away from each other in a sheet width direction.

4. The sheet-supply device according to claim 1, wherein the position change control device controls the up-and-down movement of the stopper member in accordance with the condition of the sheets that is based on a type of the sheets held by the hopper portion.

5. The sheet-supply device according to claim 4, wherein the position change control device performs a first control of the sheet feed operation, in which the stopper member is changed to the protruding position from the retracted position by the position change mechanism when a leading edge of the fed sheet passes the stopper member, and a second control of the sheet feed operation, in which the stopper member is maintained at the retracted position until the leading edge of the sheet reaches resist rollers and the retracted position of the stopper member is changed to the protruding position from the retracted position by the position change mechanism when the leading edge of the sheet reaches the resist rollers.

6. The sheet-supply device according to claim 5, wherein the position change control device performs the sheet feed operation by the first control when the sheets to be fed are determined to have a high frictional coefficient between adjacent ones of the sheets, and performs the sheet feed operation by the second control when the sheets to be fed are determined to have a low frictional coefficient between the adjacent ones of the sheets.

7. The sheet-supply device according to claim 6, wherein the position change control device performs the sheet feed operation by the first control when the sheets to be fed are matte sheets for ink-jet printer.

8. The sheet-supply device according to claim 1, wherein the position change control device controls the up-and-down movement of the stopper member in accordance with the condition of the sheets that is based on an amount of sheets held by the hopper portion.

9. The sheet-supply device according to claim 8, wherein the position change control device determines a time at which the up-an-down movement of the stopper member is performed between an instant when the sheet feed operation starts and an instant when a leading edge of the fed sheet reaches resist rollers disposed in a downstream direction in the sheet feed direction, in accordance with the amount of the sheets held by the hopper portion.

10. The sheet-supply device according to claim 1, wherein the position change control device determines a time at which the up-and-down movement of the stopper member is performed between an instant when the sheet feed operation starts and an instant when a leading edge of the fed sheet reaches resist rollers disposed in a downstream direction in the sheet feed direction, in accordance with the condition of the sheets held by the hopper portion.

11. The sheet-supply device according to claim 1, further comprising:

an urging device that contacts the topmost sheet in the stack of sheets held by the hopper portion and exerts an urging force toward the inclined wall of the hopper portion; and a sheet position control device that moves the stopper member up and down several times via the position change mechanism at a time between after the sheet feed operation is completed and before a next sheet feed operation is performed, while the sheets held by the hopper portion are urged by the urging device.

12. The sheet-supply device according to claim 11, wherein the urging device includes the sheet-supply roller and an urging member that makes the sheet-supply roller contact the topmost sheet in the stack of sheets held by the hopper portion and urges the sheets such that the sheet-supply roller and the inclined wall sandwich the sheets therebetween.

13. The sheet-supply device according to claim 11, wherein the position change control mechanism determines a number of times the stopper member moves up and down, in accordance with the condition of the sheets held by the hopper portion.

14. The sheet-supply device according to claim 1, wherein the stopper member has a regulating surface having a sawtoothed surface when viewed from side.

15. The sheet-supply device according to claim 1, wherein the position change control device controls the up-and-down movement of the stopper member in accordance with the condition of the sheets that is based on both a type and an amount of the sheets held by the hopper portion.

16. The sheet-supply device according to claim 1, wherein the hopper portion includes a hopper body having first portions, and the inclined wall has second portions that engage with the first portions to integrally connect the hopper portion and the inclined wall.

17. A sheet supply method using a sheet-supply device that includes a hopper portion that has an inclined wall for holding a stack of sheets in an inclined position and a lower edge receiving portion capable of receiving lower leading edges of the sheets that form the stack of sheets, a sheet feed mechanism that includes a sheet-supply roller which separates and feeds a topmost sheet from the stack of sheets held by the hopper portion, a stopper member that is provided to a bottom plate of the hopper portion so that a position of the stopper member can be changed between a protruding position where the stopper member protrudes from an upper surface of the bottom plate and a retracted position where the stopper member retracts below the upper surface of the bottom plate, and applies a resistance to movement of the sheets in a sheet feed direction, and a position change mechanism that changes the position of the stopper member between the protruding position and the retracted position and changes the position of the stopper member from the protruding position to the retracted position at least when a sheet feed operation is performed by the sheet-supply roller, the sheet-supply method comprising:

changing the protruding position of the stopper member to the retracted position from the protruding position by the position change mechanism;

supplying the topmost sheet from the stack of sheets held by the hopper portion by driving the sheet-supply roller of the sheet feed mechanism; and changing the position of the stopper member to the protruding position from the retracted position when a leading edge of the fed sheet passes the stopper member.

18. A sheet supply method using a sheet-supply device that includes a hopper portion that has an inclined wall for holding a stack of sheets in an inclined position and a lower edge receiving portion capable of receiving lower leading edges of the sheets that forms the stack of sheets, a sheet feed mechanism that includes a sheet-supply roller which separates and feeds a topmost sheet from the stack of sheets held by the hopper portion, a stopper member that is provided to a bottom plate of the hopper portion so that a position of the stopper member can be changed between a protruding position where the stopper member protrudes from an upper surface of the bottom plate and a retracted position where the stopper member retracts below the upper surface of the bottom plate, and applies a resistance to movement of the sheets in a sheet feed direction, and a position change mechanism that changes the position of the stopper member between the protruding position and the retracted position and changes the position of the stopper member from the protruding position to the retracted position at least when a sheet feed operation is performed by the sheet-supply roller, the sheet-supply method comprising:

changing the protruding position of the stopper member to the retracted position from the protruding position by the position change mechanism;

supplying the topmost sheet from the stack of sheets held by the hopper portion by driving the sheet-supply roller of the sheet feed mechanism; and moving the stopper member up and down several times via the position change mechanism at a time between after the sheet feed operation is completed and before a next sheet feed operation is performed.

* * * * *